US006065374A

United States Patent [19]

Taggart

[11] Patent Number: 6,065,374

[45] Date of Patent: May 23, 2000

[54] SLIDER PAWL

[75] Inventor: Kenneth Taggart, Columbia, Pa.

[73] Assignee: Hand Tool Design Corporation, Wilmington, Del.

[21] Appl. No.: 09/154,419

[22] Filed: Sep. 16, 1998

[51] Int. Cl.[7] ..... B25B 13/46

[52] U.S. Cl. ..... 81/63.2; 81/63

[58] Field of Search ..... 81/60, 61, 62, 81/63, 63.1, 63.2

[56] References Cited

U.S. PATENT DOCUMENTS

| | | | |
|---|---|---|---|
| 582,622 | 5/1897 | Dobson . | |
| 722,450 | 3/1903 | Kershner . | |
| 837,537 | 12/1906 | Beyer . | |
| 893,097 | 7/1908 | Reams | 81/63 |
| 1,635,102 | 7/1927 | Watson . | |
| 1,639,078 | 8/1927 | Coe | 81/63 |
| 2,138,331 | 11/1938 | Ward . | |
| 2,174,502 | 9/1939 | Rueb . | |
| 2,701,977 | 2/1955 | Stone | 81/63.2 |
| 2,957,377 | 10/1960 | Hare . | |
| 3,265,171 | 8/1966 | Kilness | 81/63 |
| 3,273,429 | 9/1966 | De Orlow . | |
| 3,369,416 | 2/1968 | Kilness . | |
| 3,393,780 | 7/1968 | Kilness . | |
| 3,436,992 | 4/1969 | Over et al. . | |
| 3,508,456 | 4/1970 | Schultz . | |
| 4,862,775 | 9/1989 | Chow | 81/63.2 |
| 5,230,262 | 7/1993 | Ahlund et al. | 81/63.2 |
| 5,533,427 | 7/1996 | Chow | 81/63.2 |
| 5,887,493 | 3/1999 | Main | 81/63 |

FOREIGN PATENT DOCUMENTS

| | | | |
|---|---|---|---|
| 373436 | 4/1923 | Germany | 81/63 |

*Primary Examiner*—David A. Scherbel
*Assistant Examiner*—Joni B. Danganan
*Attorney, Agent, or Firm*—Leonard Bloom

[57] ABSTRACT

A wrench having a floating pawl in a non-circular opening in the head of the wrench. The pawl has alternate positions for forward and reverse movement of the wrench. A reversing lever selectively moves an actuator to alternately engage one or the other leg of a spring within the wrench. Movement of the selected leg resiliently engages the pawl to move the pawl into the forward or reverse position. The pawl translates and rocks within the pawl opening when the wrench is ratcheted to minimize back swing arc.

39 Claims, 16 Drawing Sheets

SLIDER PAWL

BACKGROUND OF THE INVENTION

The present invention relates to a pawl in a ratchet wrench and more particularly, to a floating pawl which is moved between forward and reverse directions by a bifurcated spring.

Many types of ratchet wrenches are known which have a ratchet gear and an engaging pawl. In most of the ratchet wrenches, the pawl has a front face with two separated pairs of teeth to alternately engage teeth on the ratchet gear for forward and reverse ratcheting limiting tooth engagement to two or less teeth. Also, usually, the pawl has a pair of pockets in the back of the pawl opposite from the front face. The pawl is usually disposed in a cylindrical bore in the head of the wrench restricting the movement of the pawl to rotation. A detent means is disposed in the handle of the wrench juxtapositioned to the pockets in the pawl. As the pawl is moved by a reversing lever from one position to another, the detent means is alternately moved from one pocket to the other to urge a selected pair of teeth into engagement with the teeth on the ratchet wrench.

It is also known to have two individual pawls which are activated by a spring such as disclosed in U.S. Pat. No. 582,622 to Dobson and U.S. Pat. No. 837,537 to Beyer. Dobson discloses a U-shaped spring 14 which urges two pawls into engagement with a ratchet wheel. Beyer discloses a curved U-shaped spring which is arranged between the outer ends of pawls and normally causes the pawls to engage with teeth on a gear. The open end of the spring is oriented away from the gear.

In U.S. Pat. No. 722,450, Kershner discloses a U-shaped leaf spring having opposite sides which bear outwardly in opposite directions to force the outer ends of the "dogs" into engagement with the ratchet teeth. The opening in the spring is oriented away from the gear. In U.S. Pat. No. 1,635,102, Watson discloses a double spring. The ends of the spring engage two parts of a double dog which engage a ratchet ring. The spring is in the handle and extends into the head of the wrench. Ward, in U.S. Pat. No. 2,138,331, discloses a wrench with a pawl having converging side walls and diverging arms which is disposed in a chamber with the ratchet member. In U.S. Pat. No. 2,174,502, Rueb discloses a substantially U-shaped spring which is carried by a block. A triangular-shaped pawl has teeth at opposite ends and the pawl is secured by a pin. In U.S. Pat. No. 3,273,429, De Orlow discloses a U-shaped spring to provide a snap action of the dog. Kilness, in U.S. Pat. No. 3,393,780, discloses a U-shaped spring which alternately engages pins and causes the shift plate and the pawl to move. A detent spring and ball in a bore in the handle engages one or another side of the apex of the pawl. Schultz, in U.S. Pat. No. 3,508,456, discloses a pair of U-shaped springs which urge lock elements into locking relation with the ratchet.

Wrenches having slider pawls are also known. U.S. Pat. No. 2,957,377 to Hare discloses a wrench with a wedge-shaped pawl opening with converging straight sides and a corresponding wedge-shaped pawl. The pawl has an arcuate row of teeth. An opening is formed in the pawl at the interface of the sides of the pawl and one end of a helical coil spring is received in the opening. The other end of the helical coil spring extends into an opening in a rotating pin. Rotation of the pin shifts the pawl from one side to the other within the pawl opening.

In U.S. Pat. No. 3,369,416, Kilness discloses a pawl and a recess having inclined planar sides. A shift element is held in either of two positions by a detent ball and spring. The positioning of the pawl is under the control of the shiftable control element which is received in a recess in the pawl.

In U.S. Pat. No. 3,436,992 to Over et al, two identical, but reverse-shaped pawls are connected by a helical coil spring and disposed in an opening adjoining the ratchet teeth on the rotatable member.

None of the known references disclose nor suggest a slider pawl which is disposed between the arms of a spring and in which reverse ratcheting is produced by pivoting of the spring.

BRIEF SUMMARY OF THE INVENTION

It is the object of the present invention to provide a ratchet wrench which does not have a bore in the handle to retain a detent means to provide forward and reverse ratcheting in the pawl and has improved manufacturing economics.

It is another object of the present invention to provide a ratchet wrench having fine teeth on the ratchet gear to reduce back swing.

It is a further object of the present invention to provide a ratchet wrench in which a plurality of teeth on the pawl engage a plurality of fine teeth on the ratchet gear to reduce the occurrence of damage to the fine teeth and to reduce the overall height of the wrench while maintaining appropriate strength.

In accordance with the teaching of the present invention, there is disclosed a wrench having an elongated handle provided with a head portion. A floating pawl is in the head portion of the wrench. The pawl has alternate positions constituting the respective "forward" and "reverse" movements of the wrench. A bifurcated spring is lodged in the head portion and has a pair of free ends alternately engaging the pawl. An actuator is lodged between the arms of the spring, and an externally-accessible manually-manipulatable reversing lever is connected to the actuator for selectively moving the actuator between alternate positions. The actuator alternately engages and moves a respective one of the legs of the spring away from the pawl, and the free end of the other leg of the spring resiliently engages the pawl and moves the pawl into a respective alternate position.

In further accordance with the teachings of the present invention, there is disclosed a wrench having an elongated handle and an integral head, the head having an opening formed therein. A ratchet gear having a plurality of teeth formed axially about a circumference thereof is disposed in the opening. The wrench further has a non-circular opening communicating with the opening in the head. A pawl is disposed in the non-circular opening, the pawl having a concave front face. The front face has a plurality of spaced-apart teeth formed thereon. The pawl has a pair of opposite sides, adjoining the front face. A spring is provided having two opposite bifurcated arms and a bight portion therebetween. Each arm has a respective end. The pawl is disposed a between the ends of the arms of the spring. An actuator is disposed within the arms of the spring to dispose the ends of the spring in a first direction and in an opposite second direction. In this manner, a respective one of the ends of the spring contacts a respective side of the pawl to urge the pawl against the non-circular opening wherein the other side of the pawl is moved within the non-circular opening towards the ratchet gear such that the plurality of teeth on the pawl engage corresponding teeth on the ratchet gear to transmit force to the ratchet gear. Movement of the ends of the arms of the spring produces forward and reverse ratcheting.

In still further accordance with the teaching of the present invention, there is disclosed a wrench having an elongated handle and an integral head, the head having an opening therein. A ratchet gear having a plurality of teeth formed axially about a circumference thereof is disposed in the opening. The wrench further has a non-circular opening communicating with the opening in the head. A free-floating pawl is disposed in the non-circular opening, the pawl having a concave front face. The front face has a plurality of spaced-apart teeth formed thereon. The pawl has a pair of opposite sides adjoining the front face. A U-shaped spring is disposed adjacent to the non-circular opening, the U-shaped spring having a base and two arms. Each arm has a respective end. The pawl is disposed between the ends of the arms, the base of the spring being connected to a spring actuator. The spring actuator has a detent means attached thereto. A post is mounted between the arms of the spring wherein the detent means on the spring actuator engages one or the other side of the post. Rotation of the spring actuator with respect to the post moves the end of one of the arms to contact one of the sides of the pawl while the end of the other arm is displaced from the opposite side of the pawl. In this manner, the pawl is urged against the non-circular opening to engage the teeth on the pawl with corresponding teeth on the ratchet gear in a forward or a reverse position.

Viewed from another aspect, there is disclosed a wrench having an elongated handle and an integral head, the head having an opening therein. A ratchet gear having a plurality of teeth formed axially about a circumference thereof is disposed in the opening. The wrench has a non-circular opening communicating with the opening in the head. A free-floating pawl is disposed in the noncircular opening, the pawl having concave front face. The front face has a plurality of spaced-apart teeth formed thereon. The pawl has a pair of opposite sides adjoining the front face. A first post is mounted on the wrench distal from the non-circular opening and a second post is mounted on the wrench proximal to the non-circular opening. A hair-pin shaped spring is disposed adjacent to the non-circular opening. The hair-pin spring has two bifurcated arms and a bight portion therebetween, the bight portion engaging the first post. Each arm has a respective end. Each arm has an inwardly curved portion adjoining the bight portion and an outwardly curved fulcrum portion. The pawl and the second post are disposed between the ends of the arms. A rotatable cam is mounted on the wrench between the first post and the second post. The cam has an opposite pair of concave curved faces, the faces on the cam being configured to cooperate with the respective curved portion of the arms of the hair-pin spring. The cam has a pair of convex faces, each adjoining a respective concave face and configured to dispose the respective curved portion of the arms of the hairspring. The cam further has a detent means movable between a first and a second position. Rotating the cam to one of the detent positions moves one of the concave faces of the cam into cooperative contact with the curved portion of one of the arms of the hair-pin spring and moves the convex face of the cam into contact with the curved portion of the other arm of the hair-pin spring. In this manner, the end of the one arm is displaced from one side of the pawl and the curved portion of the other arm of the hair-pin spring is urged out of a relaxed position. The end of the arm of the hair-pin spring is urged against the other side of the pawl to urge the pawl against the non-circular opening to engage corresponding teeth on the pawl with the teeth on the ratchet gear in a forward or a reverse position.

Viewed from still another aspect, there is disclosed a wrench having an elongated handle and an integral head. The head has an opening formed therein. A ratchet gear having a plurality of teeth formed axially about a circumference thereof is disposed in the opening. The wrench further has a non-circular opening communicating with the opening in the head. A free-floating pawl is disposed in the non-circular opening. The pawl has a concave front face, the front face having a plurality of spaced-apart teeth formed thereon. The pawl has a pair of convex-curved back faces opposite the front face. Means are provided for moving the pawl laterally in a first direction and in a second opposite direction within the non-circular opening such that all of the plurality of teeth on the pawl engage corresponding teeth on the ratchet gear. Ratcheting of the wrench translates and rocks the pawl disengaging and re-engaging the teeth, the handle having an overall ratchet arc swing of approximately 7°. The means for moving the pawl produces forward and reverse ratcheting.

These and other objects of the present invention will become apparent from a reading of the following specification taken in conjunction with the enclosed drawings.

BRIEF DESCRIPTION OF THE DRAWINGS

FIG. 24 shows the teeth on the pawl fully engaged with the teeth on the ratchet gear and the back face of the pawl locked against the wall of the non-circular opening by the urging of the end of one arm of the spring.

FIG. 25 shows the pawl rocking against the wall of the noncircular opening and the teeth on the pawl near the arm of the spring being disengaged from the teeth on the ratchet gear.

FIG. 26 shows the rocking of the pawl increased so that only the teeth distal from the arm of the spring are engaged.

FIG. 27 shows the pawl rocked to the maximum and all of the teeth disengaged.

FIG. 28 shows the pawl rocking in the reverse direction by the urging of the arm of the spring and the teeth near the arm re-engaged with teeth on the ratchet gear in the next indexed position.

FIG. 29 shows the pawl rocked so that the back face is not contacting the non-circular opening and the teeth of the pawl are engaging teeth on the ratchet gear displaced one tooth from the engagement of FIG. 24.

DESCRIPTION OF THE PREFERRED EMBODIMENTS

Figure 1:
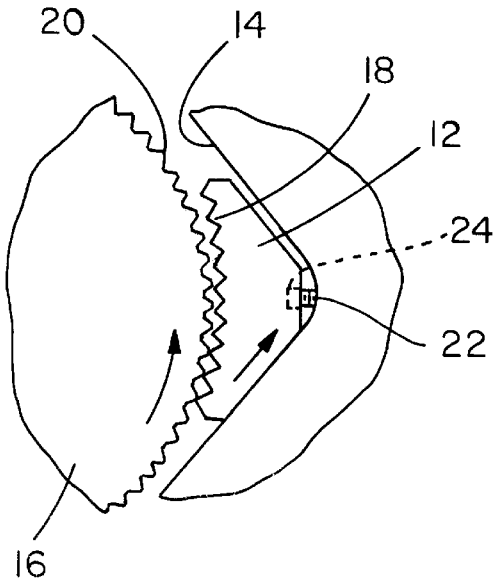
FIG. 1 PRIOR ART
FIG. 1 is a top plan partial view of the prior art showing the pawl displaced from the ratchet gear.
Figure 2:
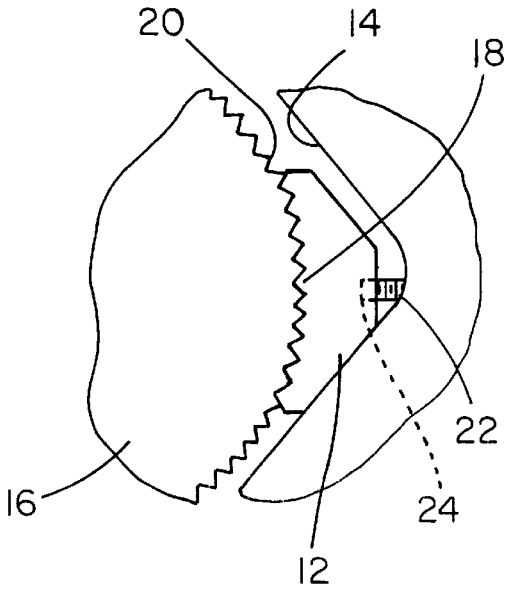
FIG. 2 PRIOR ART
FIG. 2 is a top plan partial view of the prior art showing the pawl engaged with the ratchet gear and driving the ratchet gear counterclockwise.
Figure 3:
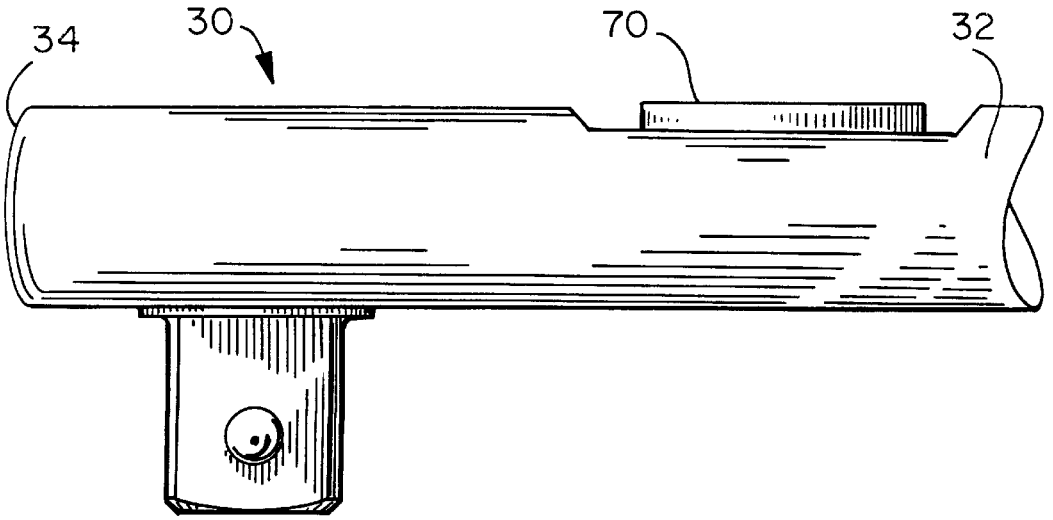
FIG. 3 is a side elevation view of the ratchet wrench of the present invention.

Referring to FIGS. 1 and 2, the prior art (U.S. Pat. No. 2,957,377) discloses a ratchet wrench with a slider pawl 12 in a pawl opening 14. The pawl opening 14 communicates with an opening for the ratchet gear 16. When the wrench is ratcheted, the teeth 18 on the pawl 12 are disengaged from the teeth 20 on the ratchet gear 16 and the pawl 12 moves laterally requiring approximately 10°–11° of handle swing. This is a movement of 5°–6° in addition to the 5° of movement required to move from one of the 72 teeth on the ratchet gear 16 to an adjoining tooth (360°÷72=5°). If there are less than 72 teeth on the ratchet gear, this angular movement is even greater. The additional 5°–6° is due to the pure translational movement of the pawl within the pawl opening 14, and the size and shape of the pawl 12. The reversing movement of the slider pawl 12 is usually produced by a spring or resilient means 22 which has one end disposed in a bore 24 in the pawl 12 and the other end connected to a reversing mechanism. The additional swing is due to the necessity to move the pawl by pure translation, to disengage the teeth and move to the next index position (5°+translation necessary to clear the tooth engagement depth).

Figure 4:
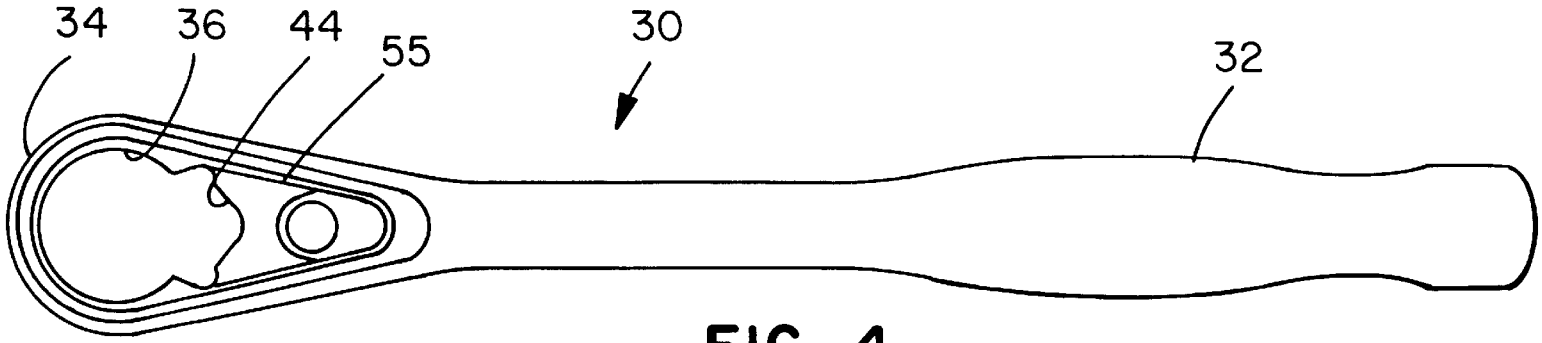
FIG. 4 is a bottom plan view of the wrench of the present invention with the cover plate, the ratchet gear, the pawl and the spring removed.
Figure 5:
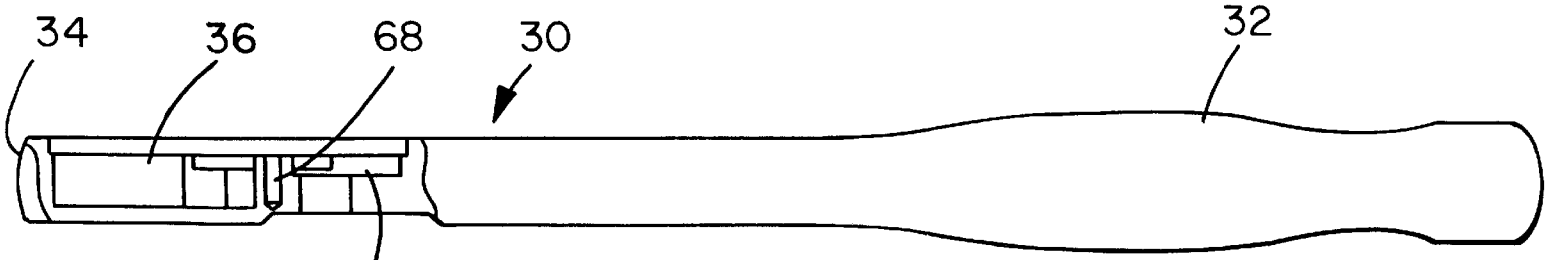
FIG. 5 is a side elevation view, in partial cut away of FIG. 4.
Figure 6:
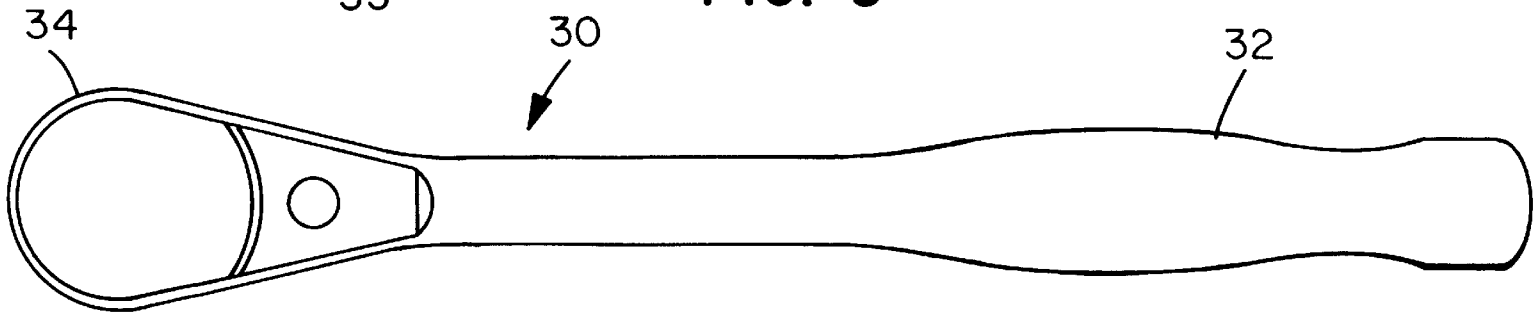
FIG. 6 is a top plan view of FIG. 4.
Figure 7:
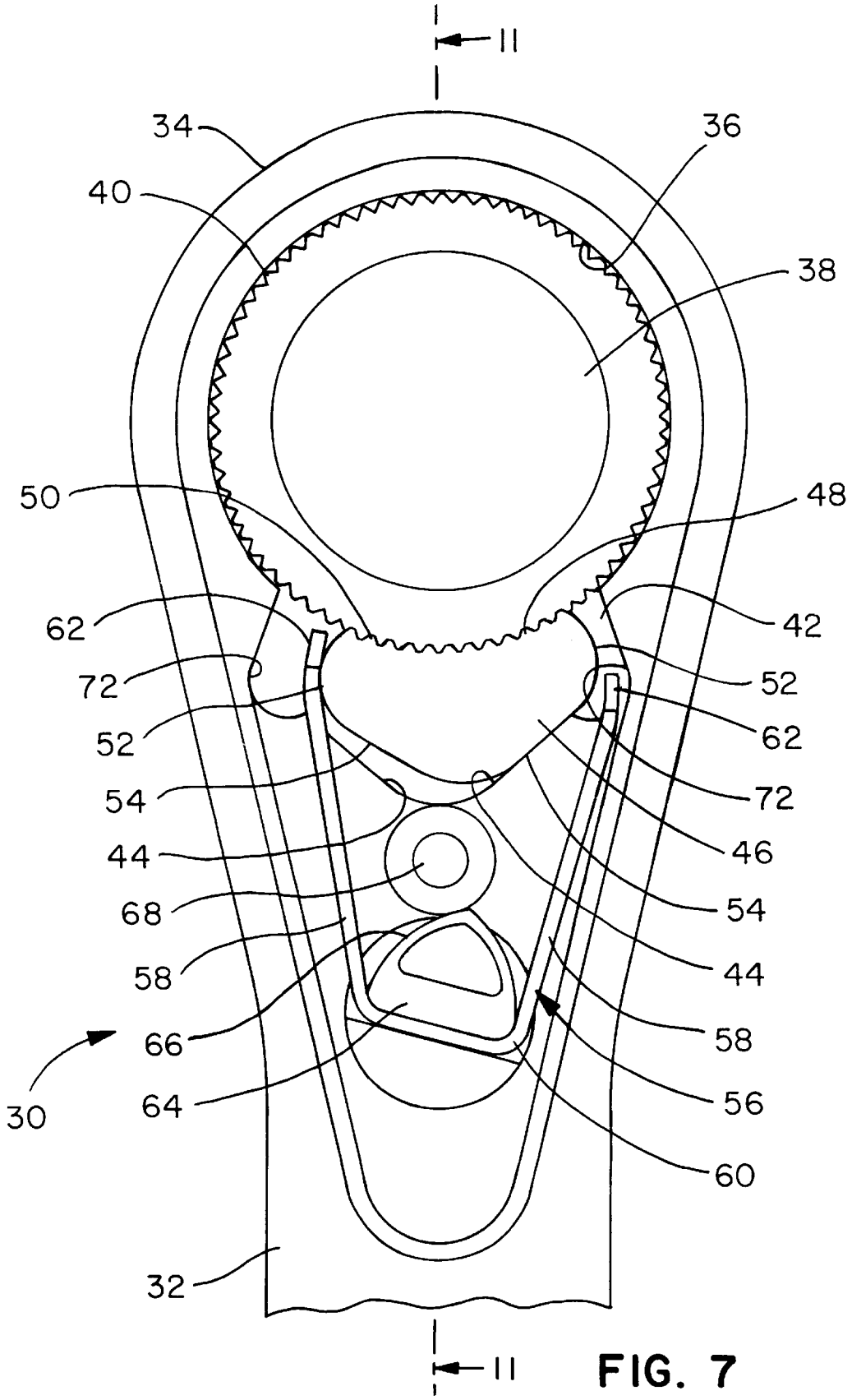
FIG. 7 is a bottom plan view of the embodiment of the present invention with the cover plate removed and showing the U-shaped spring biased in one direction.

Referring now to FIGS. 3–23, the ratchet wrench 30 of the present invention has an elongated handle 32 with an integral head 34. The head 34 has an opening 36 formed therein (FIGS. 4–5). A ratchet gear 38 has a plurality of teeth 40 formed axially about a circumference of its body (FIG. 7). Preferably, there are seventy-two (72) teeth 40 formed on the ratchet gear 38, each tooth being 5° apart from the adjoining tooth. The ratchet gear 38 has a square drive or other drive means formed thereon and extending outwardly from the head 34 of the wrench. A non-circular pawl opening 42 is formed in the head 34 of the wrench 30, the pawl opening 42 communicating with the opening 36 in the head. It is preferred that the pawl opening 42 be symmetrical and have a pair of rear walls 44 which are angularly joined distal from, and opposite to, the opening 36 in the head. Preferably, the rear walls 44 are straight (non-arcuate) except the joint between the walls is arcuate and the ends of the walls distal from the joint have an arcuate portion 72 directed toward the opening for the ratchet gear 38 and providing clearance for the unused leg of the spring (as will be described).

A pawl 46 is disposed in the non-circular pawl opening 42 such that the pawl 46 is "free floating" within the pawl opening 42. The pawl 46 may move in any direction within the pawl opening 42. The pawl 46 has a concave front face 48 on which a plurality of spaced-apart pawl teeth 50 are formed. It is preferred that the number of pawl teeth 50 may range from four (4) to twelve (12) but must cooperate fully with the gear teeth formed on gear 38. The pawl 46 has a pair of opposite sides 52 adjoining the front face 48 and a pair of angularly joined curved rear faces 54 connecting the opposite sides 52 and opposite from the front face 48. It is preferred that the juncture between the rear faces 54 be arcuate. The rear faces 54 of the pawl 46 cooperate with the rear walls 44 of the pawl opening 42.

An elongated well 55 is formed in the wrench 30 adjoining the circular gear opening 36 and extending toward the handle 32 (FIGS. 4–5). Preferably, the well 55 is widest near the pawl opening 42 and tapers to be narrower distal from the pawl opening 42. The well 55 has a depth which is less than the depth of the pawl opening 42.

Figure 9:
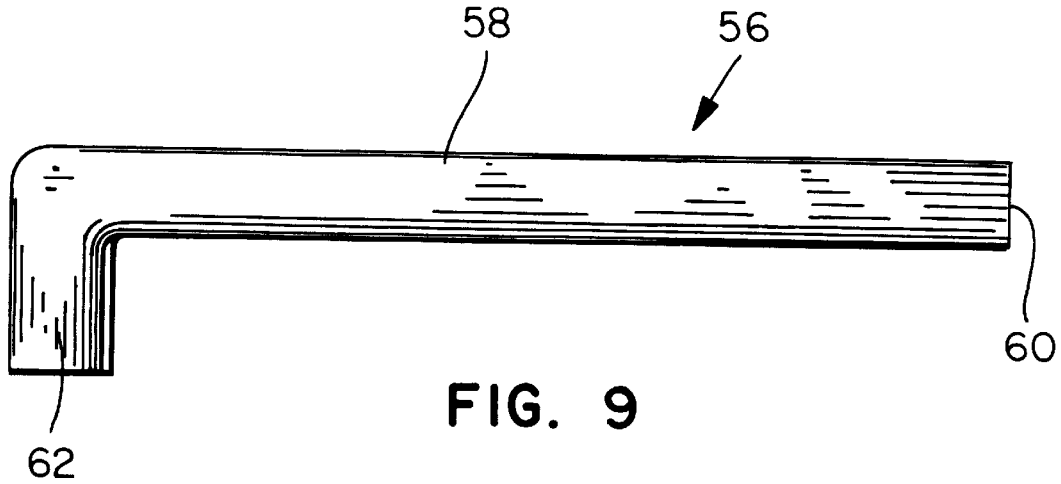
FIG. 9 is a side elevation view of the U-shaped spring.

A spring 56 having two opposite bifurcated arms 58 and a bight portion 60 therebetween, is disposed in the well 55 as will be described. Each arm 58 of the spring has a respective end 62 and the pawl 46 is disposed between the ends 62 of the arms of the spring. Preferably, the end 62 of each arm 58 is formed in the shape of an "L" approximately 900 from the respective arm 58 such that the respective ends 62 extend downwardly from the well 55 into the pawl opening 42 (FIG. 9). It is also preferred that the respective ends 62 of the arms 58 be angled slightly toward one another. In this manner, the respective ends 62 of each arm 58 may contact a significant portion of the respective sides 52 of the pawl 46 as will be described.

Figure 8:
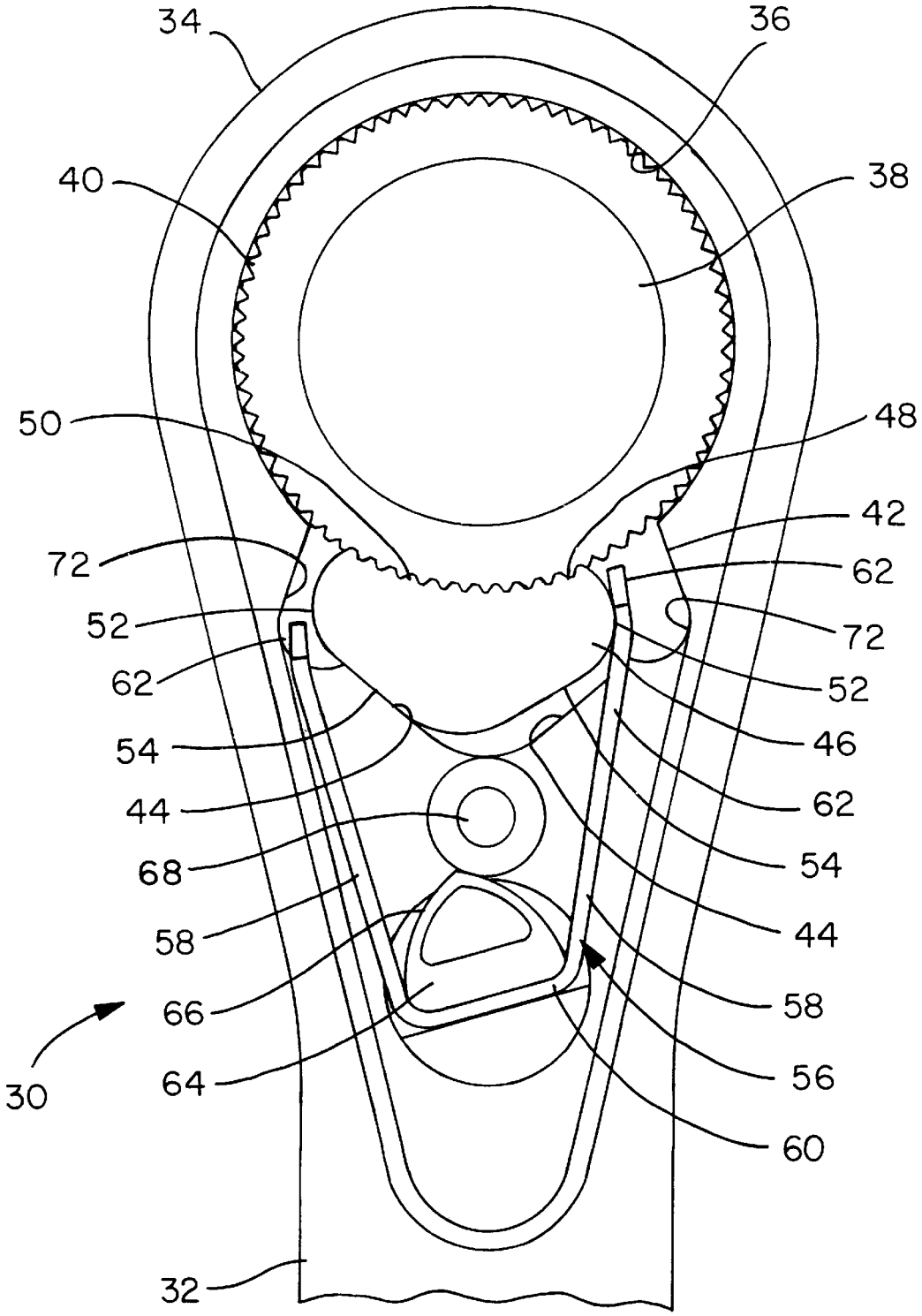
FIG. 8 is the view of FIG. 7 with the spring biased in the opposite direction.
Figure 10:
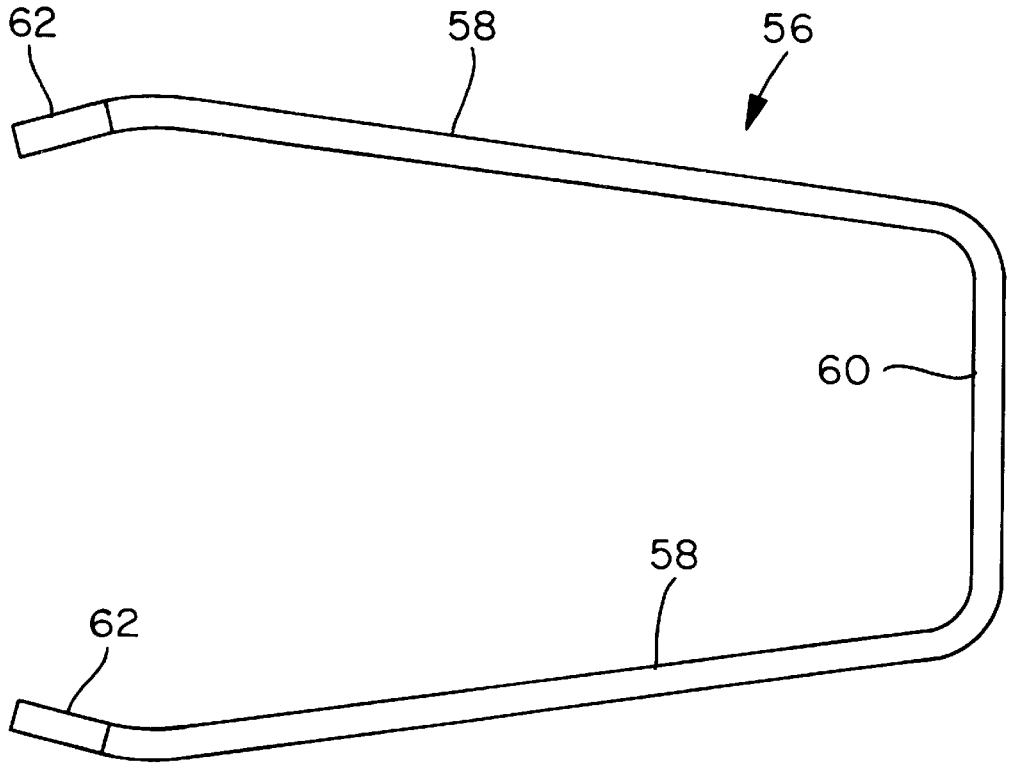
FIG. 10 is a bottom plan view of the U-shaped spring.
Figure 11:
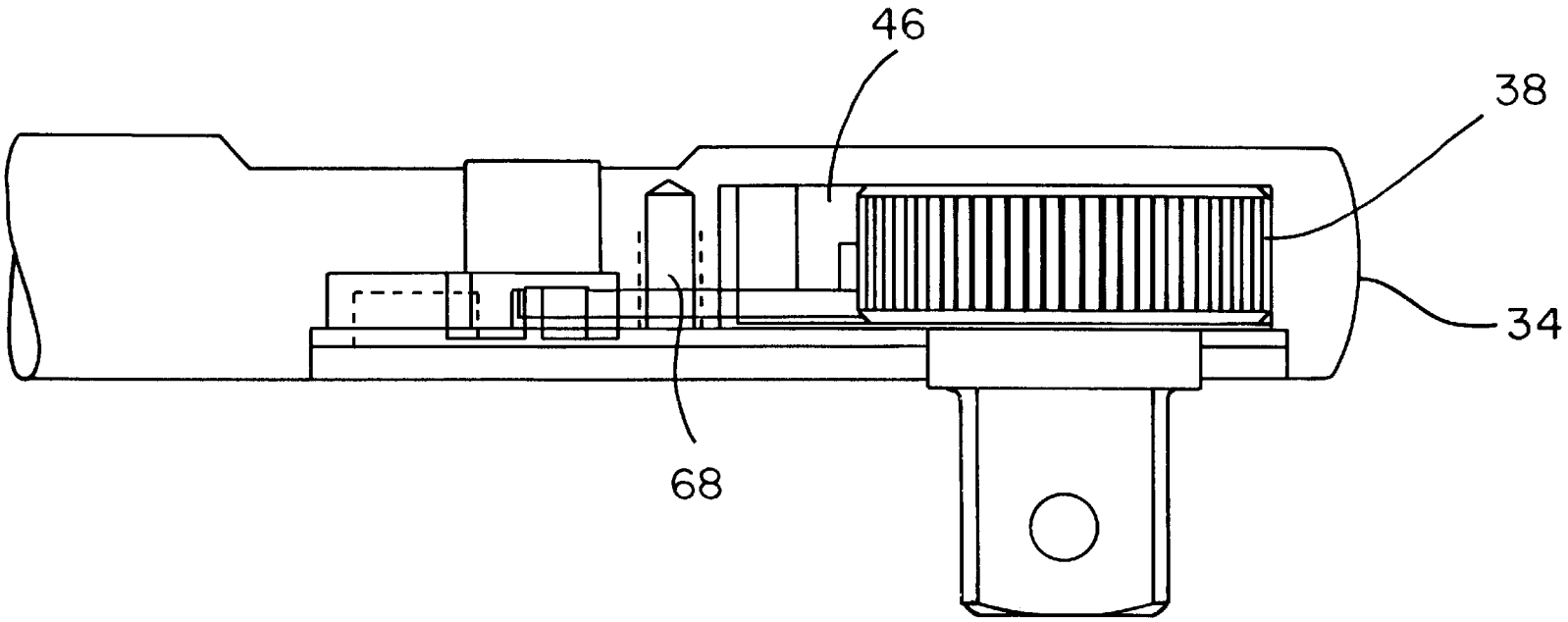
FIG. 11 is a partial cross-section view of FIG. 7 with the cover plate in place.
Figure 12:
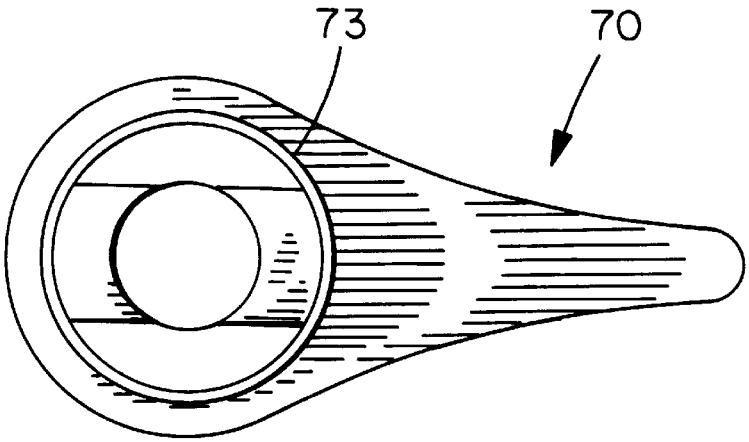
FIG. 12 is a bottom plan view of the reversing lever.
Figure 13:
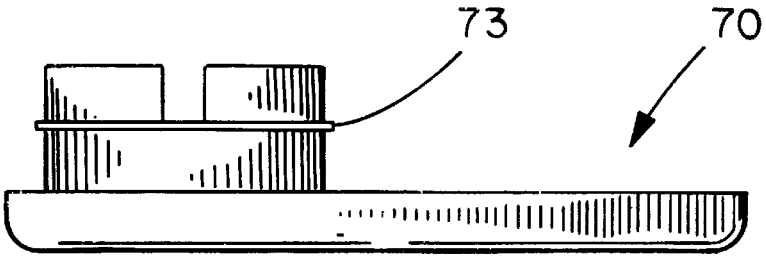
FIG. 13 is a side elevation view of the reversing lever.
Figure 14:
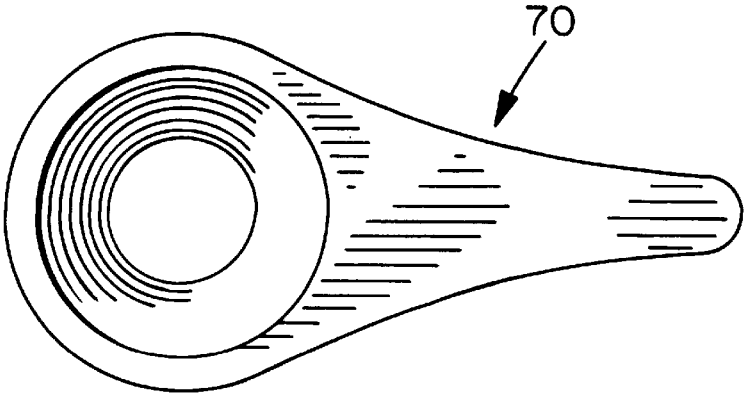
FIG. 14 is a top plan view of the reversing lever.

In one embodiment, as shown in FIGS. 7–15, the spring 56 is a U-shaped leaf spring in which the bight portion is a base from which the bifurcated arms 58 extend toward the pawl 46 (FIGS. 9–10). The base 60 is engaged into the spring actuator 64 with a detent means described below. Preferably, this engagement is via a slot in the spring actuator 64 in which the base 60 is received. The spring actuator 64 is disposed between the arms 58 of the spring 56. Opposite from the connected base 60 of the spring 56, the spring actuator 64 has a nose portion 66 which preferably has a symmetrical arch shape which is elastically deformable and serves as a detent means. A post 68 is incorporated in the well 55 between the spring actuator 64 and the non-circular pawl opening 42 with the nose portion 66 contacting the post 68. A reversing lever 70 (FIGS. 12–14) is connected to the spring actuator 64 by a keying means and is accessible externally of the wrench 30. The reversing lever 70 preferably has a deformable sealing whisker 73 formed annularly about the stem of the reversing lever 70. The sealing whisker 73 forms a seal between the stem of the reversing lever and the opening in the wrench to prevent the ingress of dirt and dust into the working components of the wrench. Manual rotation of the reversing lever 70 between a first position and a second position causes the spring actuator 64 to rotate such that a selected side of the arch shape of the nose portion 66 engages one or the other side of the post 68. Rotation of the spring actuator 64 moves the selected end 62 of one of the arms 58 of the spring 56 into contact with one of the sides 52 of the pawl 46 and disengages the end 62 of the other arm 58 from the other side 52 of the pawl 46. The deformable nose rests against the post 68 and detents or maintains the position of the spring actuator. The end 62 of the disengaged arm 58 of the spring 56 rests inside a relief area 72 in the pawl opening 42. The engaged end 62 of the arm 58 urges the pawl 46 toward the disengaged arm 58 until the rear face 54 of the pawl 46 contacts the rear wall 44 of the non-circular pawl opening 42. The continued urging of the end 62 of the engaged arm 58 brings all of the pawl teeth 50 from partial into fully meshed engagement with corresponding teeth 40 on the ratchet gear 38. The pawl 46 is wedged between the rear wall 44 of the non-circular pawl opening 42 and the ratchet gear 38 so that the pawl teeth 50 are locked to the corresponding ratchet gear teeth 40. Movement of the reversing lever 70 into an opposite position moves the spring actuator 64 causing the nose portion 66 to elastically deform to allow rotation past the post 68 so that the opposite side of the arch shape of the nose portion 66 engages the other side of the post 68 and reverses the arms 58 of the spring 56 so the formerly engaged end 62 of the arm 58 become disengaged and rests inside the relief area 72 and the formerly disengaged end 62 of the arm 58 engages the opposite side 52 of the pawl 46 (FIG. 8). The pawl 46 is urged across the pawl opening 42 until the other rear face 54 of the pawl 46 contacts the other rear wall 44 of the pawl opening 42 and the pawl moves toward the ratchet gear 38 to fully engage all of the pawl teeth 50 with corresponding ratchet gear teeth 40.

Figure 17:
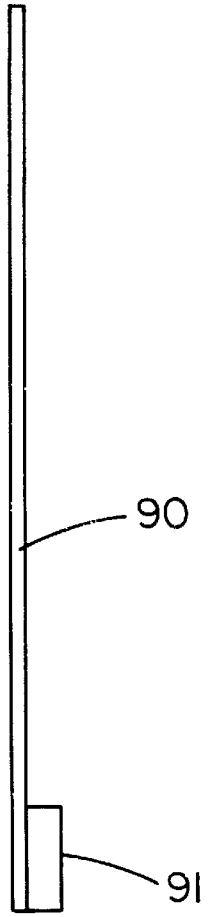
FIG. 17 is a side elevation view of the gasket of FIG. 16.
Figure 16:
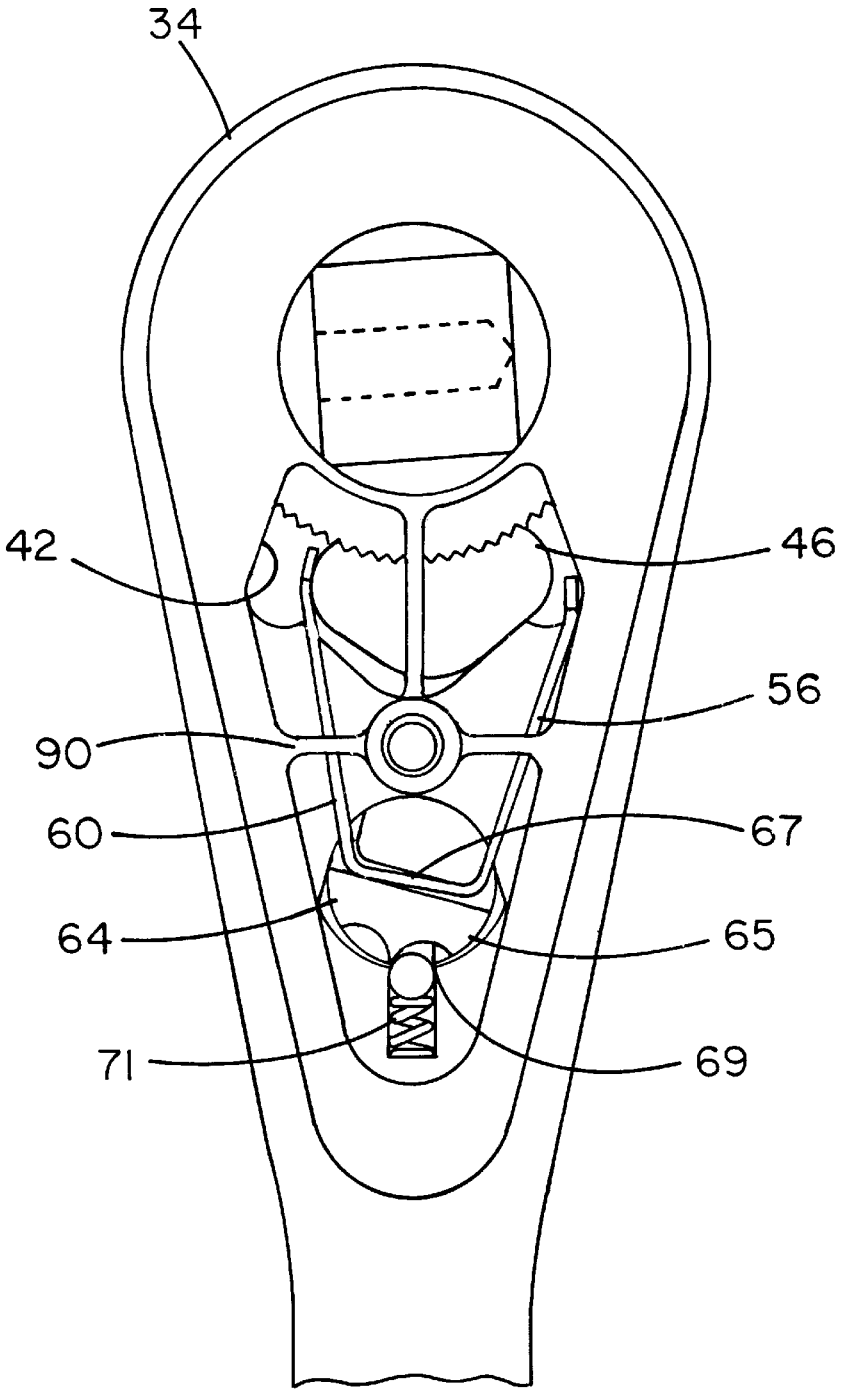
FIG. 16 is a bottom plan view of an embodiment having a spring actuator with two pockets and a detent means.
Figure 18:
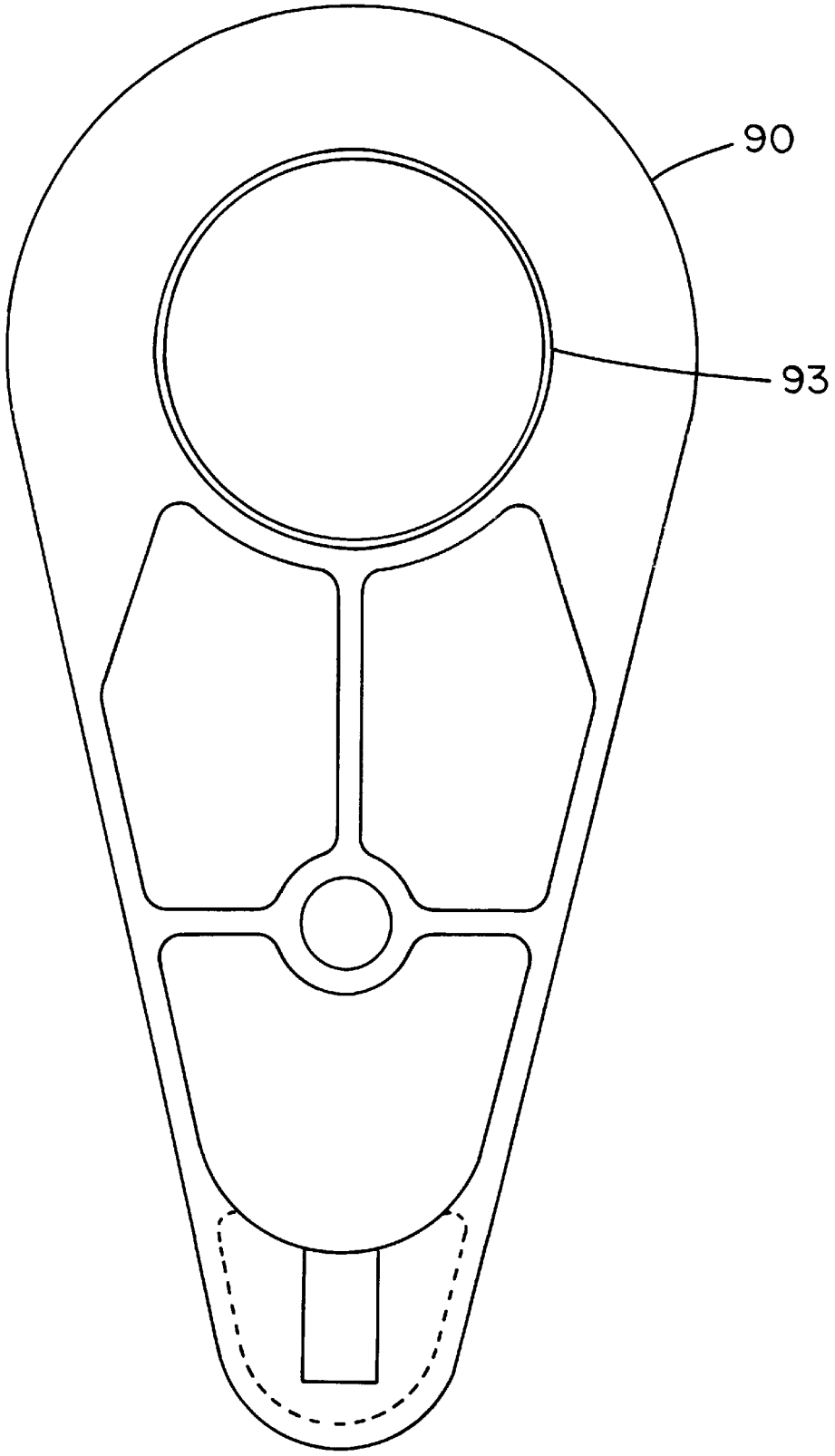
FIG. 18 is a top plan view of the gasket of FIG. 16.
Figure 19:
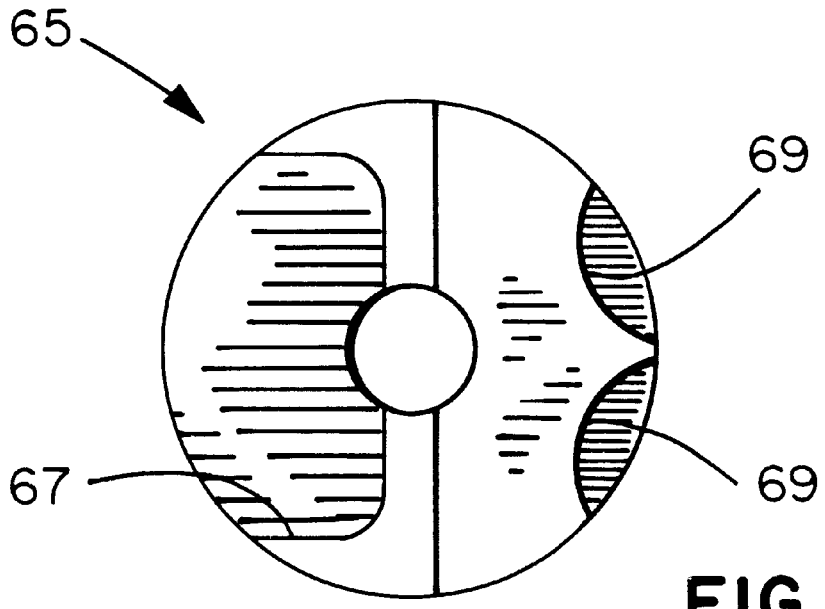
FIG. 19 is a top plan view of the spring actuator of FIG. 16.
Figure 20:
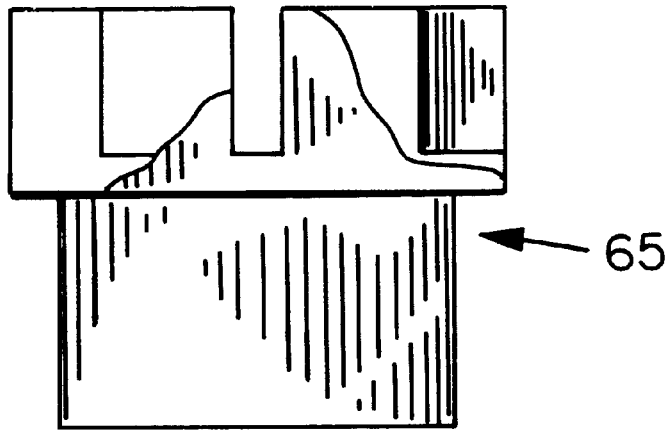
FIG. 20 is a side elevation view in partial cutaway of the spring actuator of FIG. 16.

Alternately, the spring actuator 64 may be in the form of a cylinder 65 mounted on a pin in the wrench. The cylinder 65 has a U-shaped opening or slot 67 formed on one axial face and a pair of adjoining convex pockets 69 formed on a face of the cylinder diametrically opposite from the U-shaped opening 67 (FIGS. 19–20) to cooperate with a detent means 71 (FIG. 16). The U-shaped opening 67 is oriented toward the pawl opening 42 and the base portion 60 of the spring 56 is received in the U-shaped opening 67. A gasket 90 is disposed over the spring 56 and pawl 46 (FIGS. 17–18). The end of the gasket 90 has formed thereon a dependent portion 91 which carries a ball and spring detent means 71. The ball of the detent means 71 cooperates with a selected one of the pockets 69 in the face of the spring actuator 64 when the spring actuator 64 is rotated by the actuator 70 between a forward and a reverse position to provide a repositioning action. In this manner, the spring actuator 64 is retained in the selected position and the spring 56 is moved concomitantly to engage the pawl 46.

In an alternate embodiment (FIGS. 21–23) the spring 56 is a hair-pin shaped spring. Each arm 58 has an inwardly curved portion 74 adjoining the bight portion 60. Between the respective downwardly-shaped ends 62 of each arm 58 and adjacent to the inwardly curved portion 74, there is formed an outward facing arch 76 which functions as a pivot point or fulcrum. A first post 78 is mounted in the well 55 and the bight portion 60 of the spring engages the first post 78 with the bifurcated arms 58 extending toward the pawl opening 42 with the pawl 46 disposed between the respective ends 62 of the arms 58. A second post 80 is mounted in the well 55 adjacent to the midpoint of the pawl opening 42. A rotatable cam 82 is mounted in the wrench 30 between the first post 78 and the second post 80. The cam 82 is attached to an externally accessible reversing lever 70 such that manual rotation of the reversing lever 70 between a first position and a second position causes the cam 82 to rotate. The cam 82 has an opposite pair of concave curved faces 84. An elastically deformable nose 86 is formed between the curved faces 84 at a narrow end of the cam 82. The cam 82 has convex face 88 at the wide end of the cam 82 opposite from the nose 86.

Figure 21:
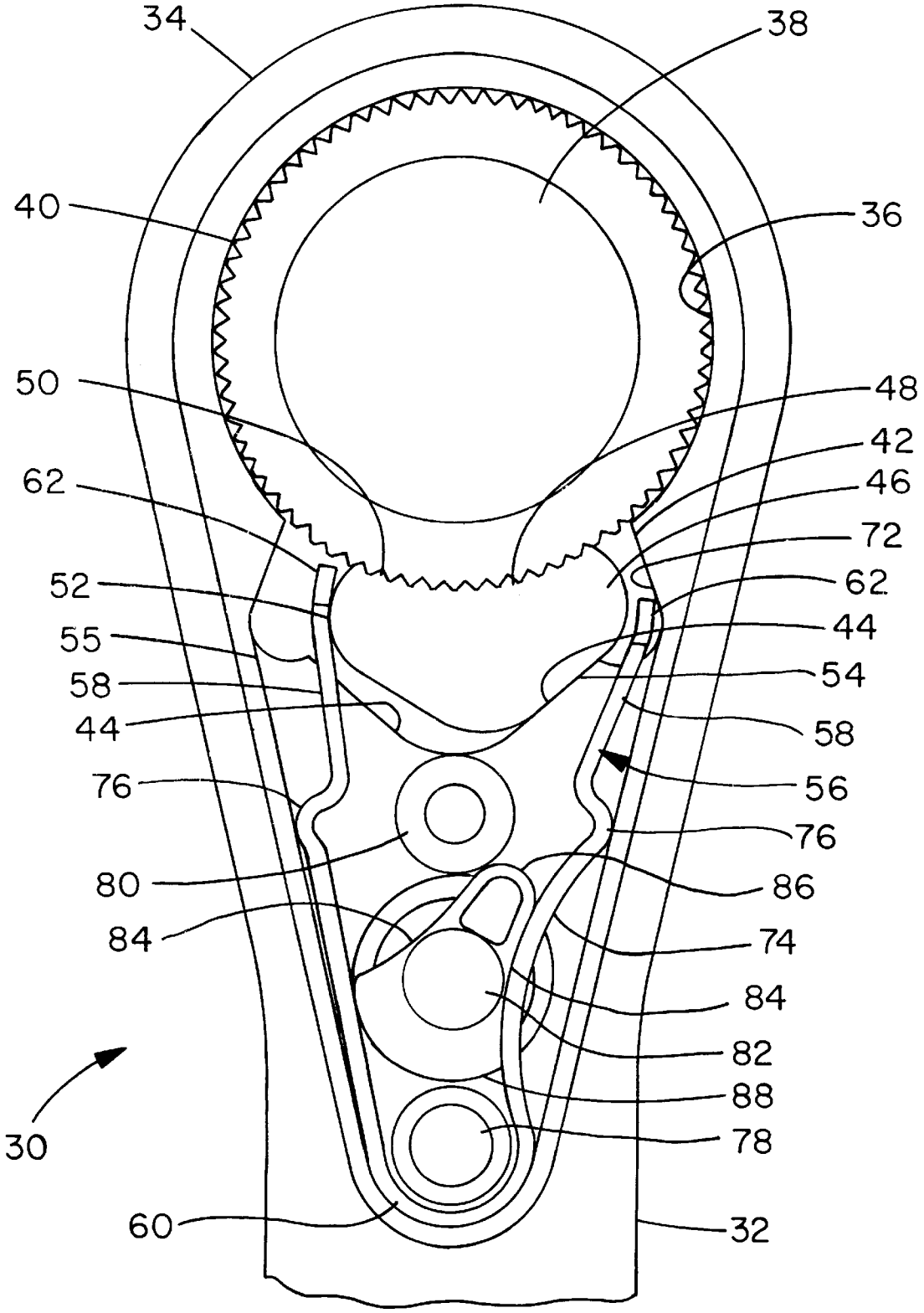
FIG. 21 is a bottom plan view of the embodiment of the present invention with the cover plate removed and showing the hair-pin shaped spring cammed in one direction.
Figure 22:
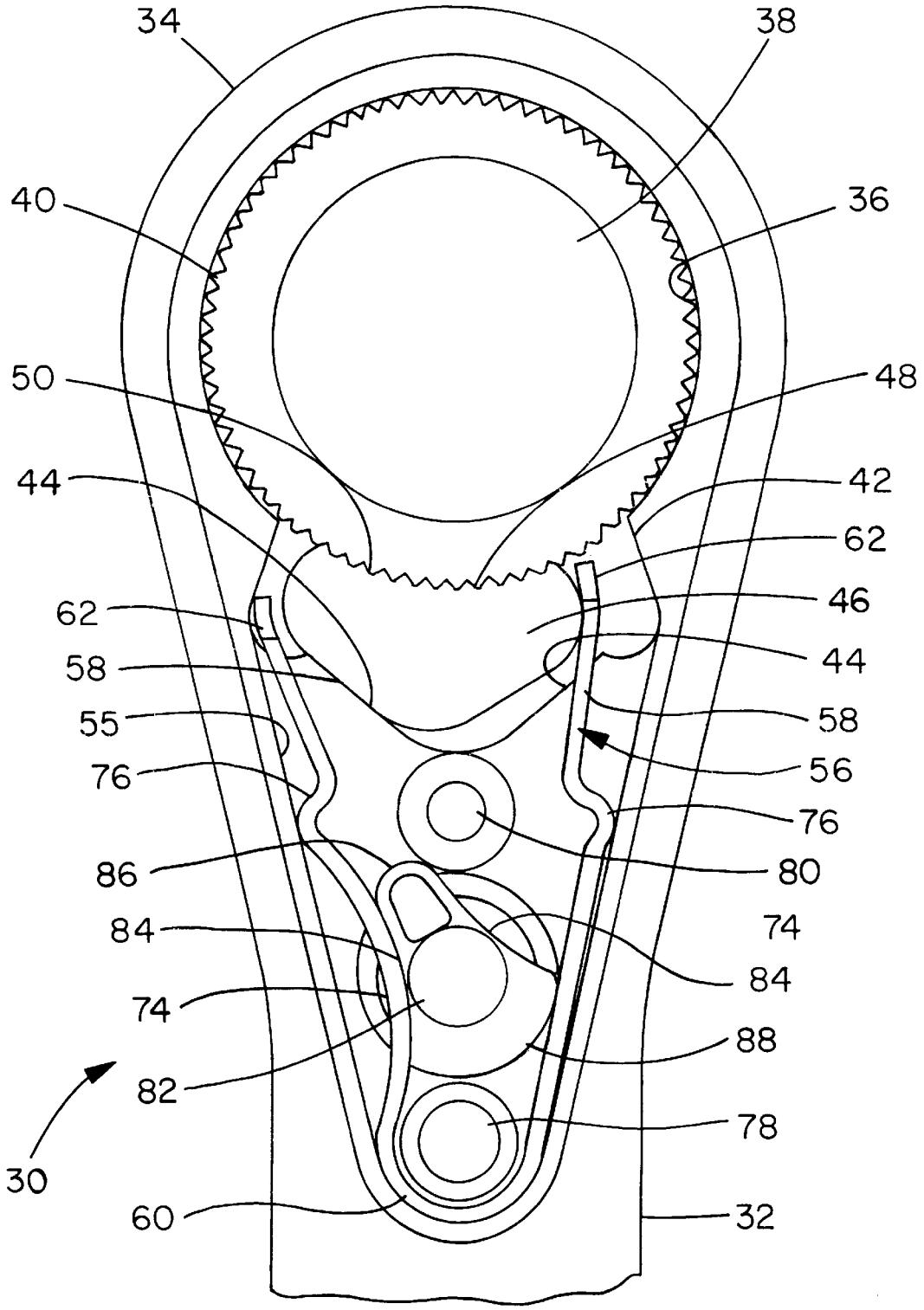
FIG. 22 is the view of FIG. 21 with the spring cammed in the opposite direction.
Figure 23:
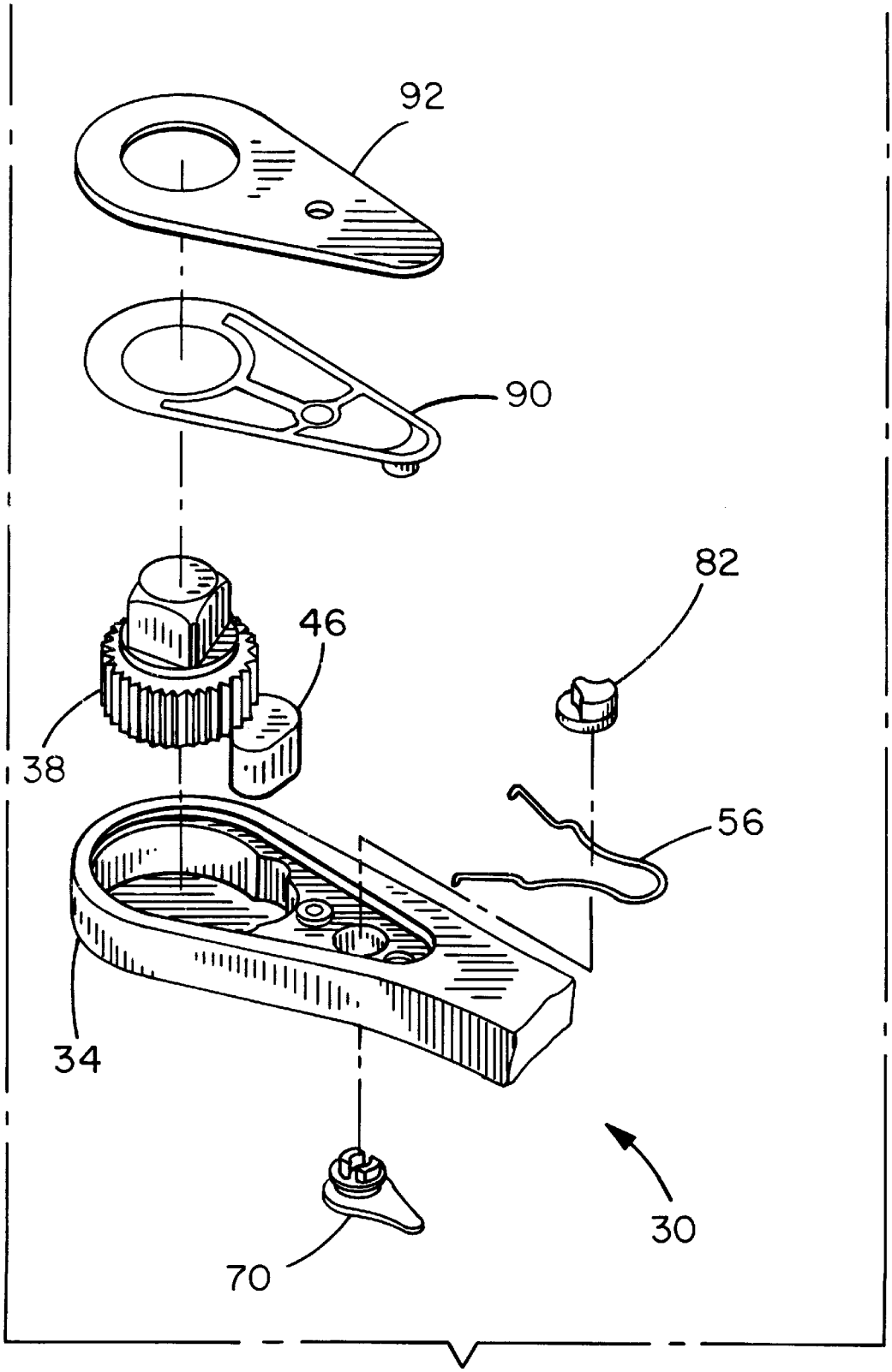
FIG. 23 is an exploded perspective view of the embodiment of FIG. 21.
Figure 24:
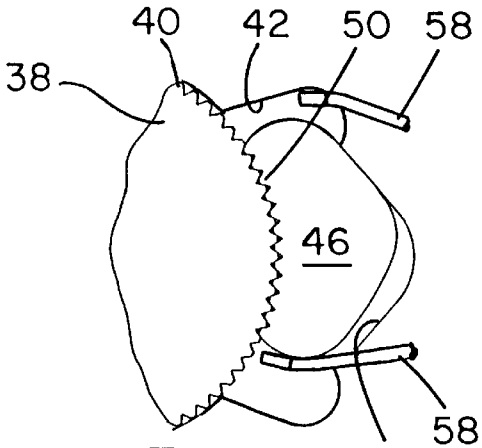
FIGS. 24–29 are a sequence of enlarged top plan views showing the movement of the pawl within the non-circular opening with respect to the ratchet gear when the wrench is ratcheted.

When the hair-pin spring 56 is in a normal position, the respective concave curved face 84 of the cam 82 is configured to cooperate with the inwardly curved portion 74 of the respective arm 58 (FIG. 21). Due to the rotational orientation of the cam 82, one of the concave curved faces 84 of the cam 82 cooperates with the relaxed inwardly curved portion 74 of one of the arms 58 and the convex face 88 on the cam 82 contacts the curved portion 74 of the other arm 58, the curved portion 74 being distorted from being inwardly curved to being almost straight or slightly outwardly curved. This causes a "seesaw" movement around arch 76, relocating the spring end 62 towards the pawl 46. As a consequence of the distortion of the other arm 58, the end 62 of the other arm 58 is brought into contact with one side 52 of the pawl 46 and the pawl 46 is urged across the pawl opening 42 until the rear face 54 of is the pawl contacts the rear wall 44 of the pawl opening 42. The continued urging of the end 62 of the other arm 58 brings all of the pawl teeth 50 from partial into fully meshed engagement with corresponding teeth 40 on the ratchet gear 38. The pawl 46 is wedged between the rear wall 44 on the non-circular pawl opening 42 and the ratchet gear 38 so that the pawl teeth 50 are locked to the corresponding ratchet gear teeth 40. The end 62 of the one arm 58 is disengaged from the pawl 46 and rests in the relief area 72 in the wrench 30.

Manual rotation of the reversing lever 70 rotates the cam 82 such that the detent means 86 moves to the opposite position and the convex face 88 of the cam 82 is displaced from the distorted portion 74 of the arm 58 of the spring 56 and the arm 58 is restored to its relaxed configuration. The other of the curved faces 84 of the cam 82 is now cooperating with the inwardly curved portion 74 of the arm 58 which has just been restored to its relaxed configuration. Also, the convex face 88 on the cam 82 now distorts the previously relaxed inwardly curved portion 74 of the arm 58 and the end 62 of the arm 58 which was displaced from the side 52 of the pawl 46 is brought into contact with the pawl 46 while the previously contacting end 62 of the arm 58 is displaced from the pawl 46 and rests in the relief area 72. The pawl 46 is urged transversely across the pawl opening 42, and as previously described, is locked into engagement with the teeth 40 on the ratchet gear 38 (FIG. 21). In this manner, reversal of ratcheting is produced.

Figure 25:
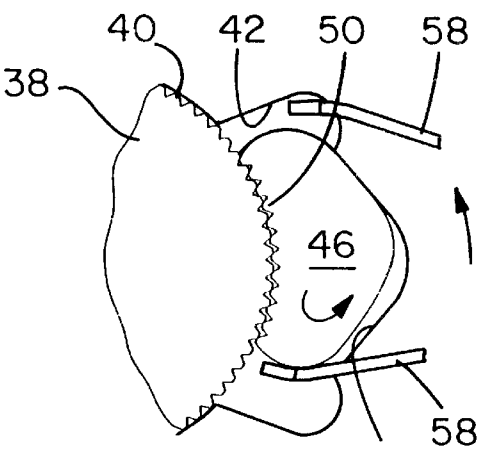
Figure 26:
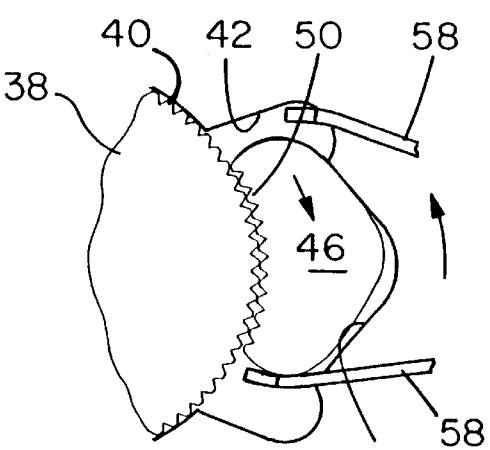
Figure 27:
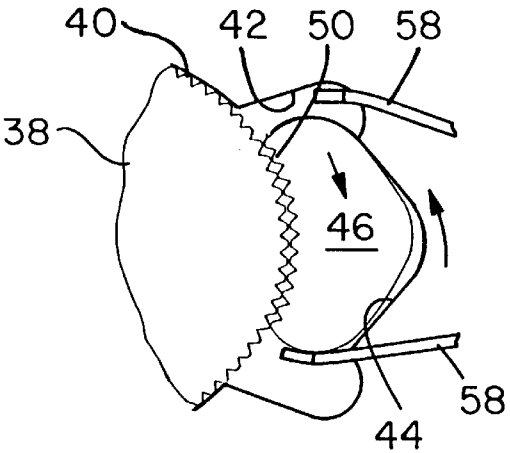
Figure 28:
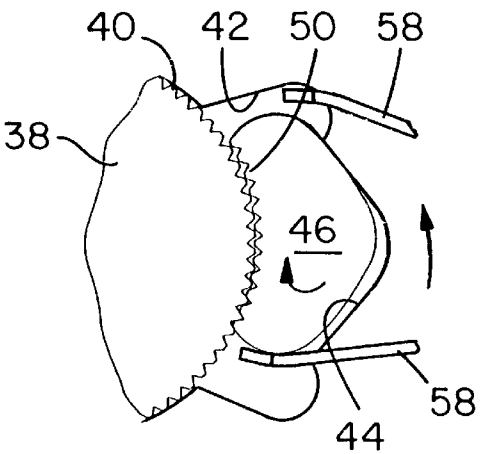
Figure 29:
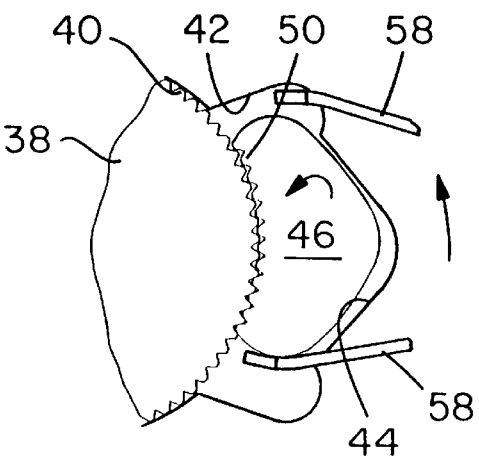

The ratcheting of the present invention is shown in FIGS. 24 to 29. The teeth 50 on the pawl 46 are in locked engagement with the ratchet gear teeth 40 and one of the rear faces 54 of the pawl 46 having a curvature (radius) is urged by the arm 58 of the spring 56 into contact with one of the non-arcuate back walls 44 of the pawl opening 42. As shown in FIG. 25, as the handle 32 is moved counterclockwise (see arrow), the pawl teeth 50 closest to the spring arm 58 begin to disengage from the ratchet gear teeth 40 due to rocking of the pawl 46 (as shown by the curved arrow on the pawl) toward the opposite back wall 44 of the pawl opening 42. The spring arm 58 is forced closer to the opposite side of the pawl opening 42 as the rocking continues and until all of the pawl teeth 50 have disengaged from the corresponding ratchet gear teeth 40 (FIG. 26). The pawl 46 is urged back toward its former position and the pawl teeth 50 slide across the ratchet gear teeth 40 (FIG. 27) to re-engage with the teeth nearest the spring arm 58 (FIG. 28). The pawl 46 moves to fully engage all of the pawl teeth 50 as in the initial stage (FIG. 29). In this manner, the pawl teeth 50 have advanced counterclockwise on the ratchet gear 38 by a distance equal to one ratchet gear tooth. Since there are 72 teeth on the ratchet gear encompassing the 360°, this is a movement of 5°. Due to the translating, rocking action of the pawl 46, there is an additional movement of approximately 2° which accounts for a total backswing of approximately 7° in ratcheting. Thus, the present invention can be used in confined spaces where the handle backswing arc is very limited.

Figure 15:
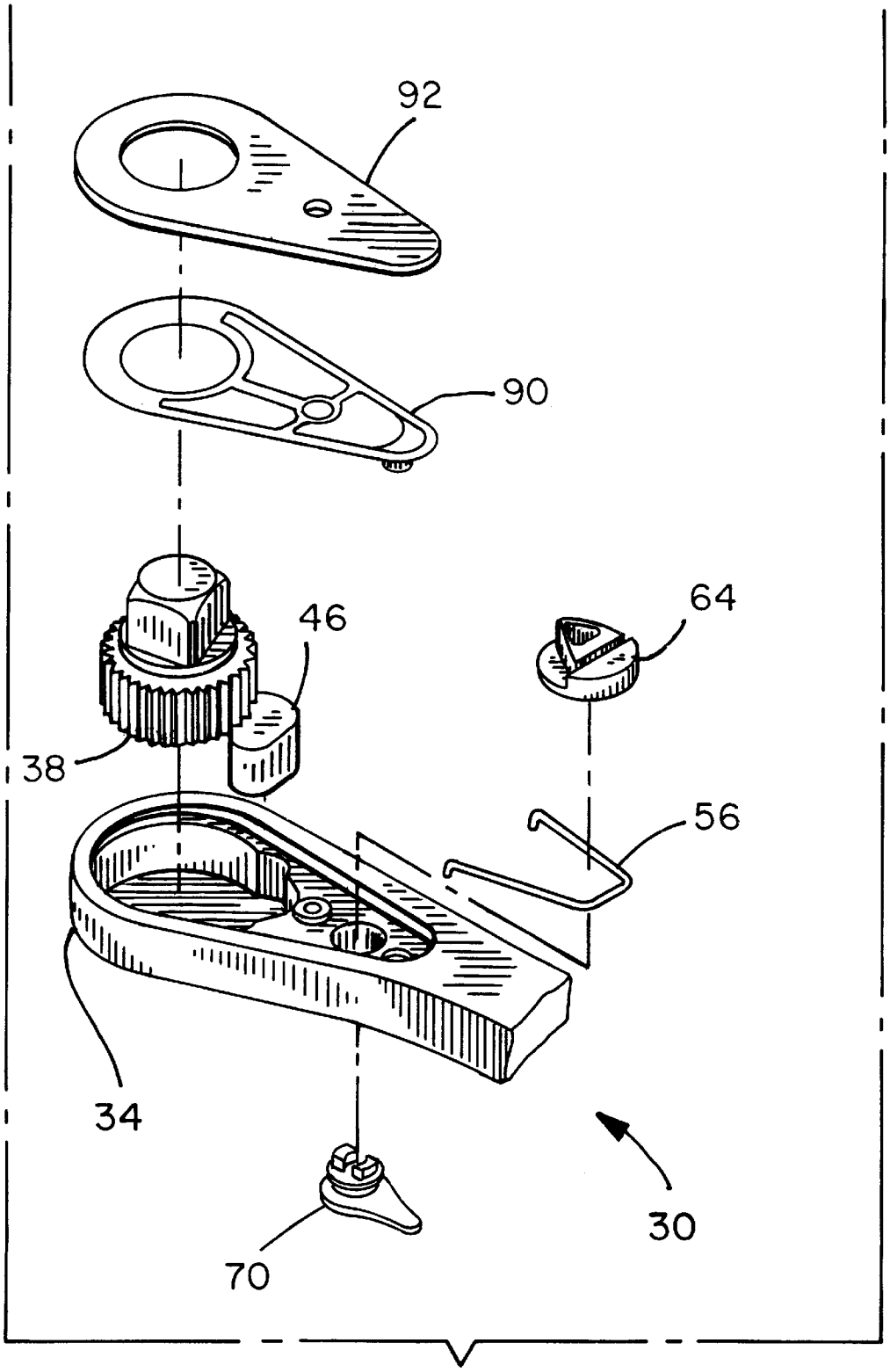
FIG. 15 is an exploded perspective view of the embodiment of FIG. 7.

As seen in FIGS. 15, 16 and 18, the wrench 30 of the present invention further has a gasket 90 and a cover plate 92. The gasket 90 is disposed between the cover plate 92 and the well 55 to provide a seal to reduce the ingress of dirt into the wrench. A deformable sealing whisker 93 is formed annularly within the opening in the gasket 90 through which the tang on the ratchet gear 38 extends. The sealing whisker 93 contacts the ratchet gear 63 and forms a seal.

Figure 30:
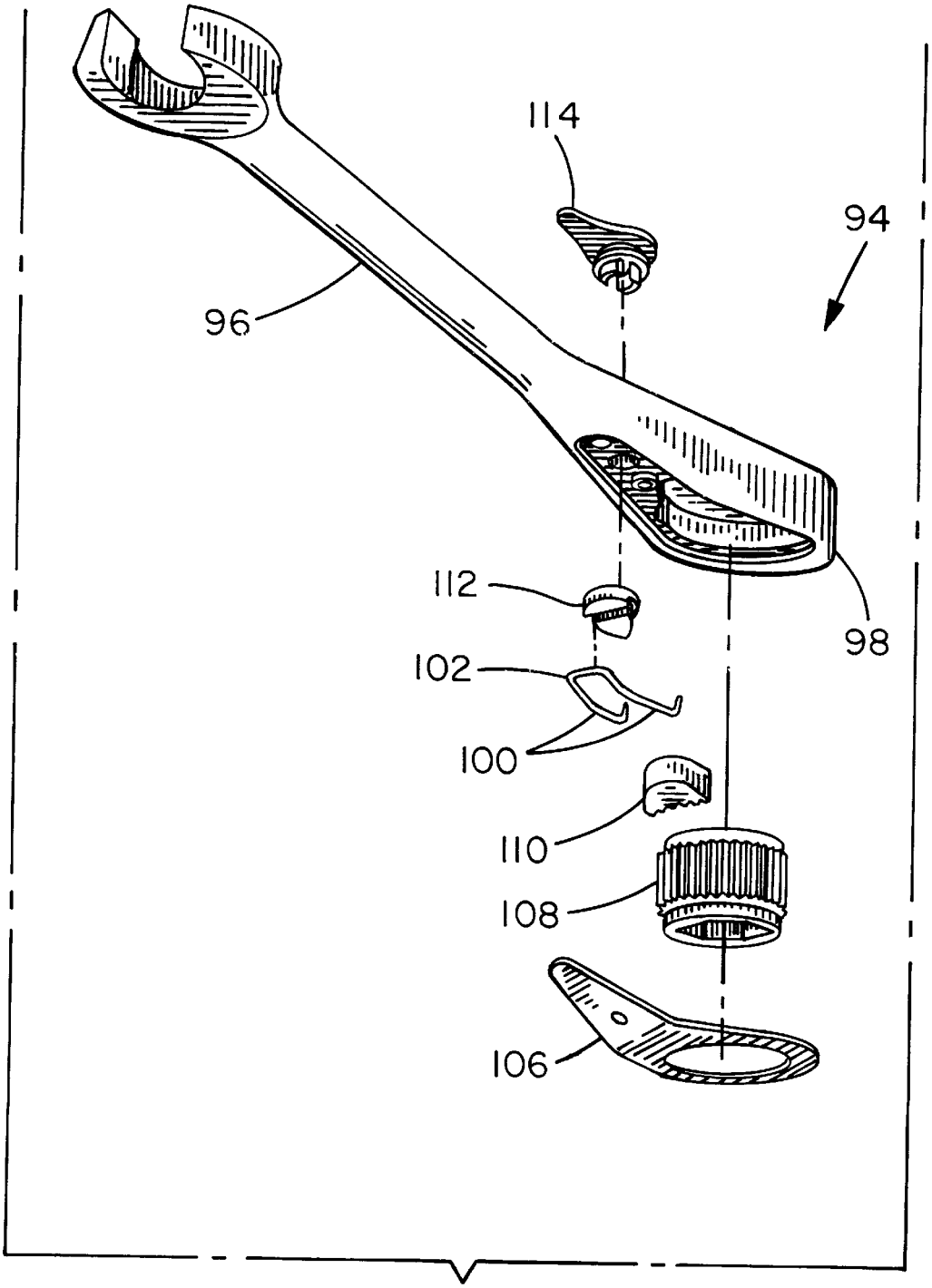
FIG. 30 is a perspective view of a box end wrench having the ratcheting system of the present invention.

As shown in FIG. 30, the wrench may be a box end wrench 94 which has a ratcheting action. The handle 96 is formed at an angle with respect to the head 98 to enable the user to have clearance for the user's hand when using the box end wrench 94 on a flat surface. Preferably, the angle is approximately 5°–25° but can exceed these limitations in special applications. The arms 100 on the spring 102 are bent at approximately the same angle as formed on the handle 96. The spring 102 may be either the U-shaped spring or the hair-pin spring as described for use in the ratchet wrench. Also the cover plate 106 is bent at a corresponding angle. The gear 108 can contain any internal configuration such as hex, square, spline, etc. The box end wrench 94 has a pawl 110, actuator 112 and reversing lever 114 which are similar in structure and operation to the corresponding components in the ratchet wrench embodiments as previously described. A gasket may be omitted in the box end wrench embodiment.

From the above, it is clear that the present invention provides advantages over the prior art. The backswing is minimized so that the wrench can be effectively used in confined spaces. The full length engagement between four to twelve pawl teeth and corresponding ratchet gear teeth provides a secure drive system which significantly reduces damage to both pawl and ratchet gear teeth even with the fine teeth on the pawl and the ratchet gear. This plurality of engagement allows the height of the ratchet gear and the pawl to be reduced as compared to the prior art and provides a wrench having a low profile while maintaining appropriate strength. The wrench can be manufactured economically without major tooling and can be easily assembled. Also the wrench can be maintained and repaired very economically.

Obviously, many modifications and combinations may be made without departing from the basic spirit of the present invention. Accordingly, it will be appreciated by those skilled in the art that within the scope of the appended claims, the invention may be practiced other than has been specifically described herein.

I claim:

1. In a wrench having an elongated handle provided with a head portion, the combination of a floating pawl in the head portion of the wrench, the pawl having alternate positions constituting the respective "forward" and "reverse" movements of the wrench, a bifurcated spring lodged in the head portion and having a pair of free ends alternately engaging the pawl, an actuator lodged between the arms of the spring, and an externally-accessible manually-manipulatable reversing lever connected to the actuator for selectively moving the actuator between alternate positions, such that the actuator alternately engages and moves a respective one of the legs of the spring away from the pawl, and such that the free end of the other leg of the spring resiliently engages the pawl and moves the pawl into a respective alternate position.

2. The combination of claim 1, wherein the head portion of the wrench includes respective relief areas for the free ends of the spring.

3. The combination of claim 1, wherein the pawl has a back face having convex curved portions on the back face, wherein the pawl rocks within the head portion and minimizes back swing arc of the wrench.

4. A wrench having an elongated handle and an integral head, the head having an opening formed therein, a ratchet gear having a plurality of teeth formed axially about a circumference thereof being disposed in the opening, the wrench further comprising a non-circular opening communicating with the opening in the head, a pawl disposed in the non-circular opening, the pawl having a concave front face, the front face having a plurality of spaced-apart teeth formed thereon, the pawl having a pair of opposite sides adjoining the front face, a spring having two opposite bifurcated arms and a bight portion therebetween, each arm having a respective end, the pawl being disposed between the ends of the arms of the spring, an actuator disposed within the arms of the spring to dispose the ends of the spring in a first direction and in an opposite second direction, wherein a respective one of the ends of the spring arms contacts one of the sides of the pawl to urge the pawl against the non-circular opening and the other of the ends of the spring arms avoids contact with the pawl wherein the other side of the pawl is moved within the non-circular opening towards the ratchet gear such that the plurality of teeth on the pawl engage corresponding teeth on the ratchet gear to transmit force to the ratchet gear and such that movement of the ends of the arms of the spring produces forward and reverse ratcheting, wherein the pawl has pair of angularly joined convex curved rear faces opposite from the front face of the pawl, the non-circular opening having a pair of angularly joined walls opposite the opening in the head of the wrench such that when the one of the arms of the spring is moved, one of the walls of the non-circular opening supports one of the rear faces of the pawl and holds the teeth of the pawl in locked engagement with the teeth on the ratchet gear.

5. A wrench having an elongated handle and an integral head, the head having an opening formed therein, a ratchet gear having a plurality of teeth formed axially about a circumference thereof being disposed in the opening, the wrench further comprising a non-circular opening communicating with the opening in the head, a pawl disposed in the non-circular opening, the pawl having a concave front face, the front face having a plurality of spaced-apart teeth formed thereon, the pawl having a pair of opposite sides adjoining the front face, a spring having two opposite bifurcated arms and a bight portion therebetween, each arm having a respective end, the pawl being disposed between the ends of the arms of the spring, an actuator disposed within the arms of the spring to dispose the ends of the spring in a first direction and in an opposite second direction, wherein a respective one of the ends of the spring arms contacts one of the sides of the pawl to urge the pawl against the non-circular opening and the other of the ends of the spring arms avoids contact with the pawl wherein the other side of the pawl is moved within the non-circular opening towards the ratchet gear such that the plurality of teeth on the pawl engage corresponding teeth on the ratchet gear to transmit force to the ratchet gear and such that movement of the ends of the arms of the spring produces forward and reverse ratcheting, wherein all of the teeth on the pawl engage corresponding teeth on the ratchet gear.

6. The wrench of claim 5, wherein the teeth on the ratchet gear and the teeth on the pawl are fine teeth.

7. The wrench of claim 5, wherein the number of teeth on the pawl may range in number from 4 to 12.

8. The wrench of claim 5, wherein there are 72 teeth on the ratchet gear.

9. A wrench having an elongated handle and an integral head, the head having an opening formed therein, a ratchet gear having a plurality of teeth formed axially about a circumference thereof being disposed in the opening, the wrench further comprising a non-circular opening communicating with the opening in the head, a pawl disposed in the non-circular opening, the pawl having a concave front face, the front face having a plurality of spaced-apart teeth formed thereon, the pawl having a pair of opposite sides adjoining the front face, a spring having two opposite bifurcated arms and a bight portion therebetween, each arm having a respective end, the pawl being disposed between the ends of the arms of the spring, an actuator disposed within the arms of the spring to dispose the ends of the spring in a first direction and in an opposite second direction, wherein a respective one of the ends of the spring arms contacts one of the sides of the pawl to urge the pawl against the non-circular opening and the other of the ends of the spring arms avoids contact with the pawl wherein the other side of the pawl is moved within the non-circular opening towards the ratchet gear such that the plurality of teeth on the pawl engage corresponding teeth on the ratchet gear to transmit force to the ratchet gear and such that movement of the ends of the arms of the spring produces forward and reverse ratcheting, wherein the spring is a U-shaped spring having straight arms.

10. A wrench having an elongated handle and an integral head, the head having an opening formed therein, a ratchet gear having a plurality of teeth formed axially about a circumference thereof being disposed in the opening, the wrench further comprising a non-circular opening communicating with the opening in the head, a pawl disposed in the non-circular opening, the pawl having a concave front face, the front face having a plurality of spaced-apart teeth formed thereon, the pawl having a pair of opposite sides adjoining the front face, a spring having two opposite bifurcated arms and a bight portion therebetween, each arm having a respective end, the pawl being disposed between the ends of the arms of the spring, an actuator disposed within the arms of the spring to dispose the ends of the spring in a first direction and in an opposite second direction, wherein a respective one of the ends of the spring arms contacts one of the sides of the pawl to urge the pawl against the non-circular opening and the other of the ends of the spring arms avoids contact with the pawl wherein the other side of the pawl is moved within the non-circular opening towards the ratchet gear such that the plurality of teeth on the pawl engage corresponding teeth on the ratchet gear to transmit force to the ratchet gear and such that movement of the ends of the arms of the spring produces forward and reverse ratcheting, wherein the spring is a hair-pin shaped spring, each of the arms having a portion curved inwardly between the bight portion and the ends and each of the arms having an outwardly curved fulcrum portion between the inwardly curved portion and the end.

11. A wrench having an elongated handle and an integral head, the head having an opening formed therein, a ratchet gear having a plurality of teeth formed axially about a circumference thereof being disposed in the opening, the wrench further comprising a non-circular opening communicating with the opening in the head, a pawl disposed in the non-circular opening, the pawl having a concave front face, the front face having a plurality of spaced-apart teeth formed thereon, the pawl having a pair of opposite sides adjoining the front face, a spring having two opposite bifurcated arms and a bight portion therebetween, each arm having a respective end, the pawl being disposed between the ends of the arms of the spring, an actuator disposed within the arms of the spring to dispose the ends of the spring in a first direction and in an opposite second direction, wherein a respective one of the ends of the spring arms contacts one of the sides of the pawl to urge the pawl against the non-circular opening and the other of the ends of the spring arms avoids contact with the pawl wherein the other side of the pawl is moved within the non-circular opening towards the ratchet gear such that the plurality of teeth on the pawl engage corresponding teeth on the ratchet gear to transmit force to the ratchet gear and such that movement of the ends of the arms of the spring produces forward and reverse ratcheting, wherein the ends of each arm of the spring are formed downwardly from the respective arms.

12. A wrench having an elongated handle and an integral head, the head having an opening formed therein, a ratchet gear having a plurality of teeth formed axially about a circumference thereof being disposed in the opening, the wrench further comprising a non-circular opening communicating with the opening in the head, a pawl disposed in the non-circular opening, the pawl having a concave front face, the front face having a plurality of spaced-apart teeth formed thereon, the pawl having a pair of opposite sides adjoining the front face, a spring having two opposite bifurcated arms and a bight portion therebetween, each arm having a respective end, the pawl being disposed between the ends of the arms of the spring, an actuator disposed within the arms of the spring to dispose the ends of the spring in a first direction and in an opposite second direction, wherein a respective one of the ends of the spring arms contacts one of the sides of the pawl to urge the pawl against the non-circular opening and the other of the ends of the spring arms avoids contact with the pawl wherein the other side of the pawl is moved within the non-circular opening towards the ratchet gear such that the plurality of teeth on the pawl engage corresponding teeth on the ratchet gear to transmit force to the ratchet gear and such that movement of the ends of the arms of the spring produces forward and reverse ratcheting, wherein the pawl floats within the non-circular opening.

13. A wrench having an elongated handle and an integral head, the head having an opening formed therein, a ratchet gear having a plurality of teeth formed axially about a circumference thereof being disposed in the opening, the wrench further comprising a non-circular opening communicating with the opening in the head, a pawl disposed in the non-circular opening, the pawl having a concave front face, the front face having a plurality of spaced-apart teeth formed thereon, the pawl having a pair of opposite sides adjoining the front face, a spring having two opposite bifurcated arms and a bight portion therebetween, each arm having a respective end, the pawl being disposed between the ends of the arms of the spring, an actuator disposed within the arms of the spring to dispose the ends of the spring in a first direction and in an opposite second direction, wherein a respective one of the ends of the spring arms contacts one of the sides of the pawl to urge the pawl against the non-circular opening and the other of the ends of the spring arms avoids contact with the pawl wherein the other side of the pawl is moved within the non-circular opening towards the ratchet gear such that the plurality of teeth on the pawl engage corresponding teeth on the ratchet gear to transmit force to the ratchet gear and such that movement of the ends of the arms of the spring produces forward and reverse ratcheting, wherein the spring is a hair-pin shaped spring, each arm having a curved portion and an outwardly curved fulcrum portion, the actuator being a rotatable cam having an opposite pair of concave faces to cooperate with the respective curved portion of the hair-pin shaped spring, the actuator having a pair of convex faces, one of the convex faces of the cam contacting the other respective curved portion of the arm and urging the curved portion outwardly such that the end of said urged arm contacts the pawl.

14. A wrench having an elongated handle and an integral head, the head having an opening formed therein, a ratchet gear having a plurality of teeth formed axially about a circumference thereof being disposed in the opening, the wrench further comprising a non-circular opening communicating with the opening in the head, a pawl disposed in the non-circular opening, the pawl having a concave front face, the front face having a plurality of spaced-apart teeth formed thereon, the pawl having a pair of opposite sides adjoining the front face, a spring having two opposite bifurcated arms and a bight portion therebetween, each arm having a respective end, the pawl being disposed between the ends of the arms of the spring, an actuator disposed within the arms of the spring to dispose the ends of the spring in a first direction and in an opposite second direction, wherein a respective one of the ends of the spring arms contacts one of the sides of the pawl to urge the pawl against the non-circular opening and the other of the ends of the spring arms avoids contact with the pawl wherein the other side of the pawl is moved within the non-circular opening towards the ratchet gear such that the plurality of teeth on the pawl engage corresponding teeth on the ratchet gear to transmit force to the ratchet gear and such that movement of the ends of the arms of the spring produces forward and reverse ratcheting, further comprising a relief area formed on opposite sides of the non-circular opening to provide clearance for the end of the spring not contacting the pawl.

15. The wrench of claim 14, wherein the pawl rocks when the wrench is ratcheted, the handle having an overall travel movement of approximately 7°.

16. A wrench having an elongated handle and an integral head, the head having an opening formed therein, a ratchet gear having a plurality of teeth formed axially about a circumference thereof being disposed in the opening, the wrench further comprising a non-circular opening communicating with the opening in the head, a pawl disposed in the non-circular opening, the pawl having a concave front face, the front face having a plurality of spaced-apart teeth formed thereon, the pawl having a pair of opposite sides adjoining the front face, a spring having two opposite bifurcated arms and a bight portion therebetween, each arm having a respective end, the pawl being disposed between the ends of the arms of the spring, an actuator disposed within the arms of the spring to dispose the ends of the spring in a first direction and in an opposite second direction, wherein a respective one of the ends of the spring arms contacts one of the sides of the pawl to urge the pawl against the non-circular opening and the other of the ends of the spring arms avoids contact with the pawl wherein the other side of the pawl is moved within the non-circular opening towards the ratchet gear such that the plurality of teeth on the pawl engage corresponding teeth on the ratchet gear to transmit force to the ratchet gear and such that movement of the ends of the arms of the spring produces forward and reverse ratcheting, wherein the wrench is a box end wrench, the handle being formed at an angle to the head, the bifurcated arms of the spring being bent at the same angle as the handle.

17. A wrench having an elongated handle and an integral head, the head having an opening formed therein, a ratchet gear having a plurality of teeth formed axially about a circumference thereof being disposed in the opening, the wrench further comprising a non-circular opening communicating with the opening in the head, a pawl disposed in the non-circular opening, the pawl having a concave front face, the front face having a plurality of spaced-apart teeth formed thereon, the pawl having a pair of opposite sides adjoining the front face, a spring having two opposite bifurcated arms and a bight portion therebetween, each arm having a respective end, the pawl being disposed between the ends of the arms of the spring, an actuator disposed within the arms of the spring to dispose the ends of the spring in a first direction and in an opposite second direction, wherein a respective one of the ends of the spring arms contacts one of the sides of the pawl to urge the pawl against the non-circular opening and the other of the ends of the spring arms avoids contact with the pawl wherein the other side of the pawl is moved within the non-circular opening towards the ratchet gear such that the plurality of teeth on the pawl engage corresponding teeth on the ratchet gear to transmit force to the ratchet gear and such that movement of the ends of the arms of the spring produces forward and reverse ratcheting, further comprising a cover plate removably mounted over the opening and the non-circular opening in the head, a gasket being disposed between the cover plate and spring, pawl and ratchet gear.

18. The wrench of claim 17, wherein the gasket carries a spring and ball detent means to engage the actuator.

19. The wrench of claim 17, wherein the gasket has an opening formed therein, a drive tang being formed on the ratchet gear and extending through the opening in the gasket, an annular inner seal whisker being formed about the opening in the gasket wherein a dirt seal is formed between the gasket and the drive tang.

20. A wrench having an elongated handle and an integral head, the head having an opening formed therein, a ratchet gear having a plurality of teeth formed axially about a circumference thereof being disposed in the opening, the wrench further comprising a non-circular opening communicating with the opening in the head, a pawl disposed in the non-circular opening, the pawl having a concave front face, the front face having a plurality of spaced-apart teeth formed thereon, the pawl having a pair of opposite sides adjoining the front face, a spring having two opposite bifurcated arms and a bight portion therebetween, each arm having a respective end, the pawl being disposed between the ends of the arms of the spring, an actuator disposed within the arms of the spring to dispose the ends of the spring in a first direction and in an opposite second direction, wherein a respective one of the ends of the spring arms contacts one of the sides of the pawl to urge the pawl against the non-circular opening and the other of the ends of the spring arms avoids contact with the pawl wherein the other side of the pawl is moved within the non-circular opening towards the ratchet gear such that the plurality of teeth on the pawl engage corresponding teeth on the ratchet gear to transmit force to the ratchet gear and such that movement of the ends of the arms of the spring produces forward and reverse ratcheting, wherein the actuator engages a detent means to control movement of the actuator between a first position and a second position.

21. The wrench of claim 20, wherein the detent means is an elastomeric deformable nose on the actuator, said nose engaging one or the other side of a post mounted between the arms of the spring.

22. The wrench of claim 20, wherein the actuator has a pair of adjacent pockets formed therein, the detent means being a spring and ball engaging one or the other of the adjacent pockets.

23. A wrench having an elongated handle and an integral head, the head having an opening formed therein, a ratchet gear having a plurality of teeth formed axially about a circumference thereof being disposed in the opening, the wrench further comprising a non-circular opening communicating with the opening in the head, a pawl disposed in the non-circular opening, the pawl having a concave front face, the front face having a plurality of spaced-apart teeth formed thereon, the pawl having a pair of opposite sides adjoining the front face, a spring having two opposite bifurcated arms and a bight portion therebetween, each arm having a respective end, the pawl being disposed between the ends of the arms of the spring, an actuator disposed within the arms of the spring to dispose the ends of the spring in a first direction and in an opposite second direction, wherein a respective one of the ends of the spring arms contacts one of the sides of the pawl to urge the pawl against the non-circular opening and the other of the ends of the spring arms avoids contact with the pawl wherein the other side of the pawl is moved within the non-circular opening towards the ratchet gear such that the plurality of teeth on the pawl engage corresponding teeth on the ratchet gear to transmit force to the ratchet gear and such that movement of the ends of the arms of the spring produces forward and reverse ratcheting, a reversing lever having a stem, the stem being connected to the spring actuator by a keying means, wherein manual rotation of the reversing lever moves the ends of the arms of the spring between the first direction and the second direction, and further comprising a sealing whisker formed annularly about the stem of the reversing lever such that a seal is formed to prevent the ingress of dirt and dust.

24. A wrench having an elongated handle and an integral head, the head having an opening therein, a ratchet gear having a plurality of teeth formed axially about a circumference thereof being disposed in the opening, the wrench further comprising a non-circular opening communicating with the opening in the head, a free-floating pawl disposed in the non-circular opening, the pawl having a concave front face, the front face having a plurality of spaced-apart teeth formed thereon, the pawl having a pair of opposite sides adjoining the front face, a U-shaped spring disposed adjacent to the non-circular opening, the U-shaped spring having a base and two arms, each arm having a respective end, the pawl being disposed between the ends of the arms, the base of the spring being connected to a spring actuator, the spring actuator having a detent means attached thereto, a post mounted between the arms of the spring wherein the detent means on the spring actuator engages one or the other side of the post, such that rotation of the spring actuator with respect to the post positions the end of one of the arms to contact one of the sides of the pawl while the end of the other arm is displaced from the opposite side of the pawl, wherein the pawl is urged against the non-circular opening to engage the teeth on the pawl with corresponding teeth on the ratchet gear in a forward or a reverse position.

25. The wrench of claim 24, wherein all of the teeth on the pawl engage corresponding teeth on the ratchet gear.

26. The wrench of claim 24, further comprising the pawl having a pair of angularly joined convex curved rear faces opposite from the front face, the non-circular opening having a pair of angularly joined non-arcuate walls opposite the opening in the head of the wrench, such that when the end of the spring arm is positioned, one of the walls of the non-circular opening supports one of the convex curved rear faces of the pawl and holds the teeth of the pawl in locked engagement with the corresponding teeth of the ratchet gear.

27. The wrench of claim 24, wherein the ends of each arm of the spring are formed downwardly from the respective arms.

28. The wrench of claim 24, wherein the spring actuator has an elastically deformable nose, said nose engaging one or the other side of the post.

29. The wrench of claim 24, wherein the spring actuator has two adjacent concave pockets formed therein, the detent means being a ball and spring cooperating with one or the other of the concave pockets.

30. The wrench of claim 24, wherein the wrench is a box end wrench, the handle being formed at an angle with respect to the head, the arms of the spring being bent at the same angle as the handle.

31. A wrench having an elongated handle and an integral head, the head having an opening therein, a ratchet gear having a plurality of teeth formed axially about a circumference thereof being disposed in the opening, the wrench further comprising a non-circular opening communicating with the opening in the head, a free-floating pawl disposed in the non-circular opening, the pawl having a concave front face, the front face having a plurality of spaced-apart teeth formed thereon, the pawl having a pair of opposite sides adjoining the front face, a first post mounted on the wrench distal from the noncircular opening and a second post mounted on the wrench proximal to the non-circular opening, a hair-pin shaped spring disposed adjacent to the noncircular opening, the hair-pin spring having two bifurcated arms and a bight portion therebetween, the bight portion engaging the first post, each arm having a respective end, each arm having an inwardly curved portion adjoining the bight portion and an outwardly curved fulcrum portion, the pawl and the second post being disposed between the ends of the arms, a rotatable cam being mounted on the wrench between the first post and the second post, the cam having an opposite pair of concave curved faces, the faces on the cam being configured to cooperate with the respective inwardly curved portion of the arms of the hair-pin spring, the cam having a pair of convex faces, each adjoining one of the respective concave faces and configured to dispose the respective curved portion of the arm of the hair-pin spring, the cam further having a detent means moveable between a first and a second position, such that rotating the cam into one of the detent positions moves one of the concave faces of the cam into cooperative contact with the inwardly curved portion of one of the arms of the hair-pin spring and moves one of the convex faces of the cam into contact with the curved portion of the other arm of the hair-pin spring, wherein the end of the one arm is displaced from one side of the pawl and wherein the curved portion of the other arm of the hair-pin spring is urged out of a relaxed position such that the end of the corresponding arm of the hair-pin spring is urged against the other side of the pawl to urge the pawl against the non-circular opening to engage corresponding teeth on the pawl with the teeth on the ratchet gear in a forward or a reverse position.

32. The wrench of claim 31, wherein all of the teeth on the pawl engage corresponding teeth on the ratchet gear.

33. The wrench of claim 31, further comprising the pawl having a pair of angularly joined convex rear faces opposite from the front face, the non-circular opening having a pair of angularly joined non-arcuate walls opposite the opening in the head of the wrench, such that when the spring is cammed, one of the walls of the non-circular opening supports one of the rear faces of the pawl and holds the teeth of the pawl in locked engagement with the corresponding teeth of the ratchet gear and the pawl may rock within the non-circular opening.

34. The wrench of claim 31, wherein the ends of each arm of the spring are formed downwardly from the respective arms.

35. The wrench of claim 31, wherein the nose of the cam is elastically deformable.

36. The wrench of claim 31, wherein the wrench is a box end wrench, the handle being formed at an angle with respect to the head, the bifurcated arms of the spring being bent at the same angle as the handle.

37. A wrench having an elongated handle and an integral head, the head having an opening formed therein, a ratchet gear having a plurality of teeth formed axially about a circumference thereof being disposed in the opening, the wrench further comprising a non-circular opening communicating with the opening in the head, a free-floating pawl disposed in the non-circular opening, the pawl having a concave front face, the front face having a plurality of spaced-apart teeth formed thereon, the pawl having a pair of angularly joined convex curved back faces opposite the front face, means for moving the pawl laterally in a first direction and in a second opposite direction within the non-circular opening such that all of the plurality of teeth on the pawl engage corresponding teeth on the ratchet gear and wherein ratcheting of the wrench translates and rocks the pawl, disengaging and re-engaging the teeth, the handle having an overall travel movement of approximately 7°, and wherein the means for moving the pawl produces forward and reverse ratcheting, wherein the means for moving the pawl is a spring having two opposite bifurcated arms and a bight portion therebetween, each arm having a respective end, the pawl being disposed between the ends of the arms of the spring, the ends of the arms of the spring being moveable between the first direction and the opposite second direction.

38. The wrench of claim 37, wherein the wrench is a box end wrench, the handle being formed at an angle with respect to the head, the bifurcated arms of the spring being bent at the same angle as the handle.

39. A wrench having an elongated handle and an integral head, the head having an opening formed therein, a ratchet gear having a plurality of teeth formed axially about a circumference thereof being disposed in the opening, the wrench further comprising a non-circular opening communicating with the opening in the head, a free-floating pawl disposed in the non-circular opening, the pawl having a concave front face, the front face having a plurality of spaced-apart teeth formed thereon, the pawl having a pair of angularly joined convex curved back faces opposite the front face, means for moving the pawl laterally in a first direction and in a second opposite direction within the non-circular opening such that all of the plurality of teeth on the pawl engage corresponding teeth on the ratchet gear and wherein ratcheting of the wrench translates and rocks the pawl, disengaging and re-engaging the teeth, the handle having an overall travel movement of approximately 7°, and wherein the means for moving the pawl produces forward and reverse ratcheting, further comprising the noncircular opening having a pair of angularly joined non-arcuate walls opposite the opening in the head of the wrench, such that when the means for moving the pawl laterally is moved, one of the walls of the non-circular opening supports one of the back faces of the pawl and holds the teeth of the pawl in locked engagement with the corresponding teeth of the ratchet gear.

* * * * *